US010829263B1

(12) United States Patent
Little

(10) Patent No.: US 10,829,263 B1
(45) Date of Patent: Nov. 10, 2020

(54) ONE-PIECE CONTAINER WITH INTERNAL SUPPORT STRUCTURE

(71) Applicant: Troy M. Little, Thomasville, PA (US)

(72) Inventor: Troy M. Little, Thomasville, PA (US)

(73) Assignee: GYRE INNOVATIONS, LLC, York, PA (US)

( * ) Notice: Subject to any disclaimer, the term of this patent is extended or adjusted under 35 U.S.C. 154(b) by 0 days.

(21) Appl. No.: 16/420,402

(22) Filed: May 23, 2019

(51) Int. Cl.
*B65D 5/22* (2006.01)
*B65D 5/468* (2006.01)
*B65D 5/42* (2006.01)

(52) U.S. Cl.
CPC ..... *B65D 5/22* (2013.01); *B65D 5/4266* (2013.01); *B65D 5/4608* (2013.01)

(58) Field of Classification Search
CPC ..... B65D 5/22; B65D 5/4266; B65D 5/4608; B65D 5/48014; B65D 5/001; B65D 5/0015; B65D 5/307; B65D 5/321; B65D 5/443; B65D 5/5007
USPC ..... 229/165, 122.32, 919, 164, 178, 185.1, 229/915, 172; 206/509, 736; 220/651; 493/89
See application file for complete search history.

(56) References Cited

U.S. PATENT DOCUMENTS

| | | | | |
|---|---|---|---|---|
| 3,055,573 | A * | 9/1962 | Carter | B65D 5/002 229/178 |
| 4,101,048 | A * | 7/1978 | Rieben | B65D 5/0045 229/117.16 |
| 5,535,942 | A * | 7/1996 | Vilona | B65D 5/0035 229/199 |
| 7,677,433 | B2 | 3/2010 | Little | |
| 7,810,707 | B2 | 10/2010 | Little | |
| 7,819,305 | B2 | 10/2010 | Little | |
| 7,861,916 | B2 | 1/2011 | Little | |
| 7,981,017 | B2 | 7/2011 | Little et al. | |
| 8,177,117 | B2 | 5/2012 | Little | |
| 8,297,490 | B2 | 10/2012 | Little et al. | |
| 8,887,985 | B2 | 11/2014 | Laughman et al. | |
| 8,925,795 | B2 | 1/2015 | Little | |
| 9,022,276 | B2 | 5/2015 | Little | |
| 9,290,294 | B2 | 3/2016 | Laughman et al. | |
| 9,434,501 | B2 | 9/2016 | Little | |
| 2010/0083618 | A1 | 4/2010 | Little | |
| 2010/0087304 | A1 | 4/2010 | Little | |
| 2011/0011922 | A1 | 1/2011 | Little | |
| 2017/0240315 | A1 | 8/2017 | Little | |

* cited by examiner

*Primary Examiner* — Christopher R Demeree
(74) *Attorney, Agent, or Firm* — Barnes & Thornburg LLP

(57) ABSTRACT

A one-piece blank and preassembly for constructing a container having an internal support structure includes a bottom panel, a wall panel or combination panel, and an auxiliary panel connected to the wall panel or combination panel. The auxiliary panel and the wall or combination panel are configured so that portions of the auxiliary panel automatically change state from co-planar to three-dimensional upon manipulation of the wall panel or combination panel to form the container.

23 Claims, 15 Drawing Sheets

E
T4
G
C
T3
T2
160
F2
F1
F3
E2
148
E1
146
152
A
144
G1
138
G2
140
G3
142
G4
130
156
126
128
164
D1
D2
124
162
154
B3
B2
116
110
T1
D
102,104
B1
114
166
B

E
160
T4
158
T2
F2
F1
F3
E2
148
E1
146
A
144
138
G1
168
C2
140
G2
G3
C3
126
128
164
D2
D1
162
B3
116
B2
166
B
D
102,104

168
C2
V2
C3
G3
G2
G1
E2
A
D1
V1
F3
B3
F2
F1
B2
166
104

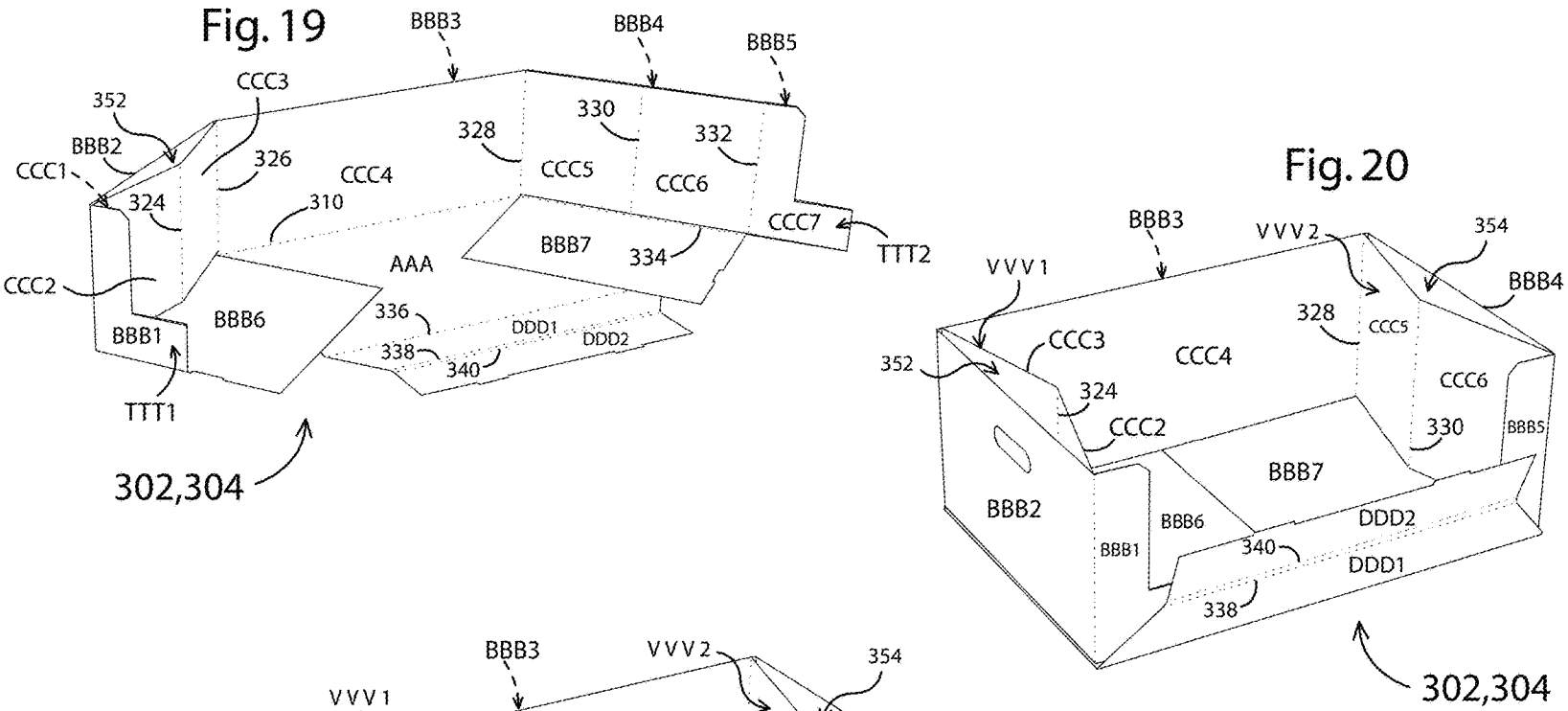
Fig. 20
Fig. 19
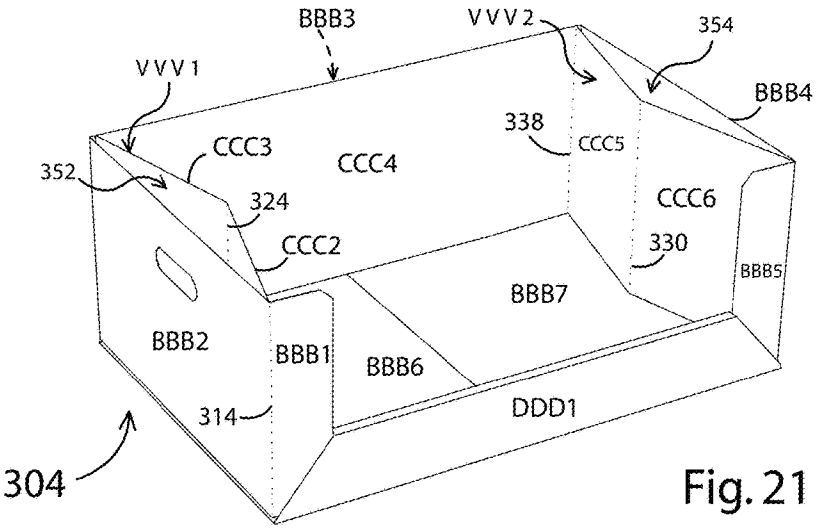
Fig. 21

ONE-PIECE CONTAINER WITH INTERNAL SUPPORT STRUCTURE

BACKGROUND AND SUMMARY OF THE DISCLOSURE

Retail-ready containers having internal support structure for supporting similar retail-ready containers thereupon are known in the art.

Such known containers may be erected from a preassembly including a primary blank and one or more supplementary blanks adhered to the primary blank. The preassembly may be erected so that the primary blank forms the walls and bottom of the container, and so that the supplementary blanks form supports within the walls and bottom of the container. Alternatively, the supplementary blanks may be separate or separable from the primary blank. In such an embodiment, the preassembly may be erected so that the primary blank forms the walls and bottom of the container, and the supplementary blanks may be separately formed into supports and then loosely disposed within the walls and bottom of the container.

The use of supplementary blanks to form the supports may create at least three problems. First, special equipment may be required to manufacture a preassembly including supplementary blanks adhered to a primary blank.

Second, in embodiments wherein the supplementary blanks are adhered to the primary blank, the supplementary blanks must be precisely aligned with the primary blank during manufacture of the preassembly. Failure to precisely align the supplementary blanks with the primary blank during manufacture of the preassembly may yield a preassembly that cannot readily be erected to form a container having the desired configuration. For example, misaligned blanks could cause either the main body of the container or the internal supports to be distorted when the container is erected, such that the container, the supports, or both are unattractive or suffer from impaired functionality.

Third, in embodiments wherein the supplementary blanks are separate or separable from the primary blank, a user would need to erect the primary blank to form the container, separately erect the supplementary blanks to form the supports, and then insert the separately erected supports into the container. In such an embodiment, the supports typically would be loosely disposed within the container so that the supports could collapse while supporting an additional container thereupon. Such collapse could result in breakage of product disposed within the containers, as well as damage to the containers or a retail display including the containers.

The present disclosure is directed to a retail-ready container including internal supports that may be erected from a preassembly including only a single blank. Notwithstanding, such a preassembly could include supplementary blanks directed to functions other than providing internal support for another container thereon.

BRIEF DESCRIPTION OF THE DRAWINGS

FIG. 1A is a detail view of a portion of the blank of FIG. 1;

FIG. 1B is a detail view of another portion of the blank of FIG. 1;

FIG. 1C is a detail view of yet another portion of the blank of FIG. 1;

FIG. 1D is a detail view of still another portion of the blank of FIG. 1;

FIG. 8A is a detail view of a portion of the blank of FIG. 8;

FIG. 8B is a detail view of another portion of the blank of FIG. 8;

FIG. 8C is a detail view of yet another portion of the blank of FIG. 8;

FIG. 8D is a detail view of still another portion of the blank of FIG. 8;

FIG. 15A is a detail view of a portion of the blank of FIG. 15;

FIG. 15B is a detail view of another portion of the blank of FIG. 15;

FIG. 15C is a detail view of yet another portion of the blank of FIG. 15;

FIG. 19 is a view of the preassembly of FIG. 18 partially erected into a container;

FIG. 20 is a view of the preassembly of FIG. 18 further erected into a container; and FIG. 21 is a view of a container erected from the preassembly of FIG. 18.

DETAILED DESCRIPTION OF THE DRAWINGS

Figure 1:
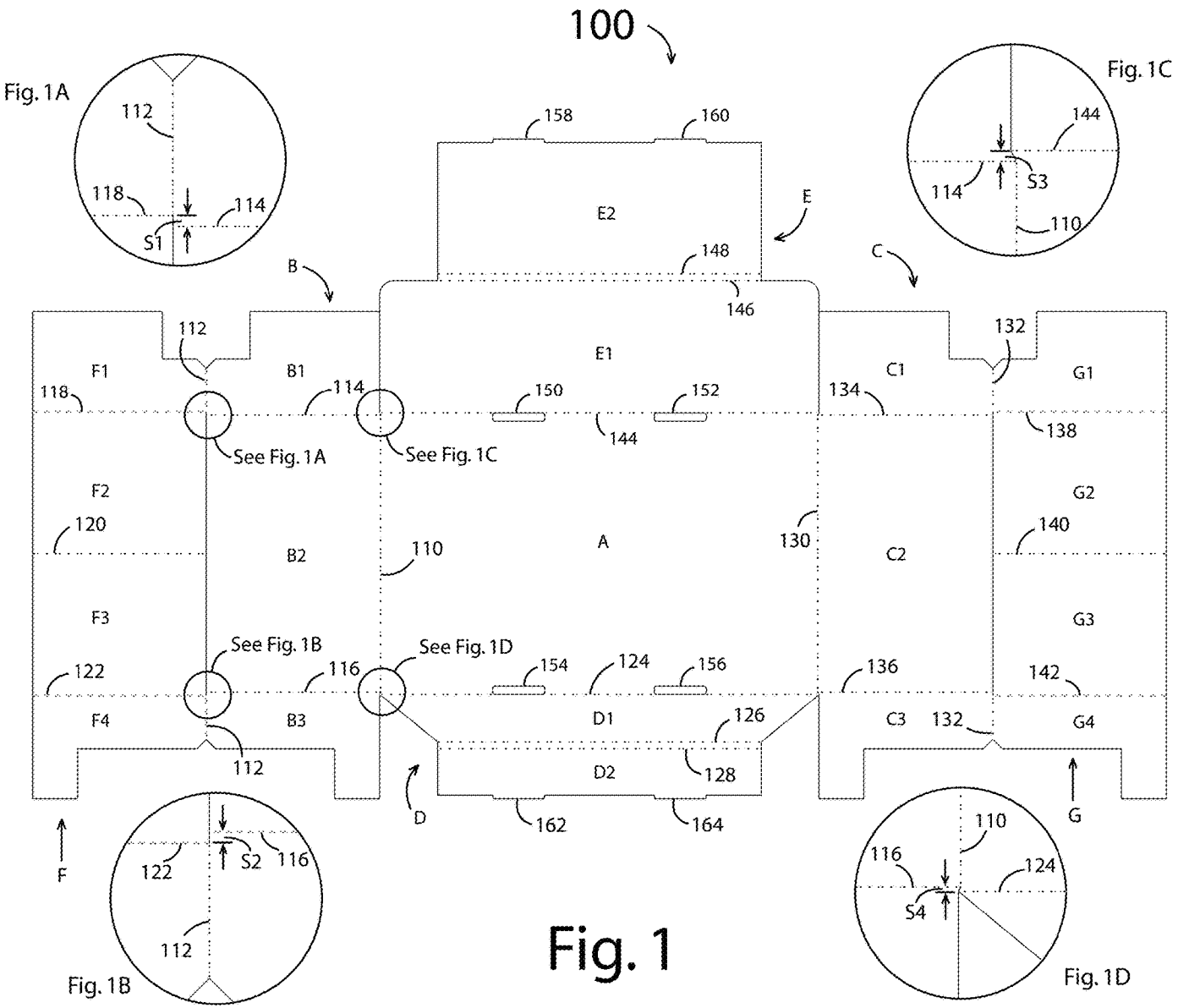
FIG. 1 is a plan view of an illustrative blank from which a first illustrative embodiment of a container may be erected according to the present disclosure.
Figure 2:
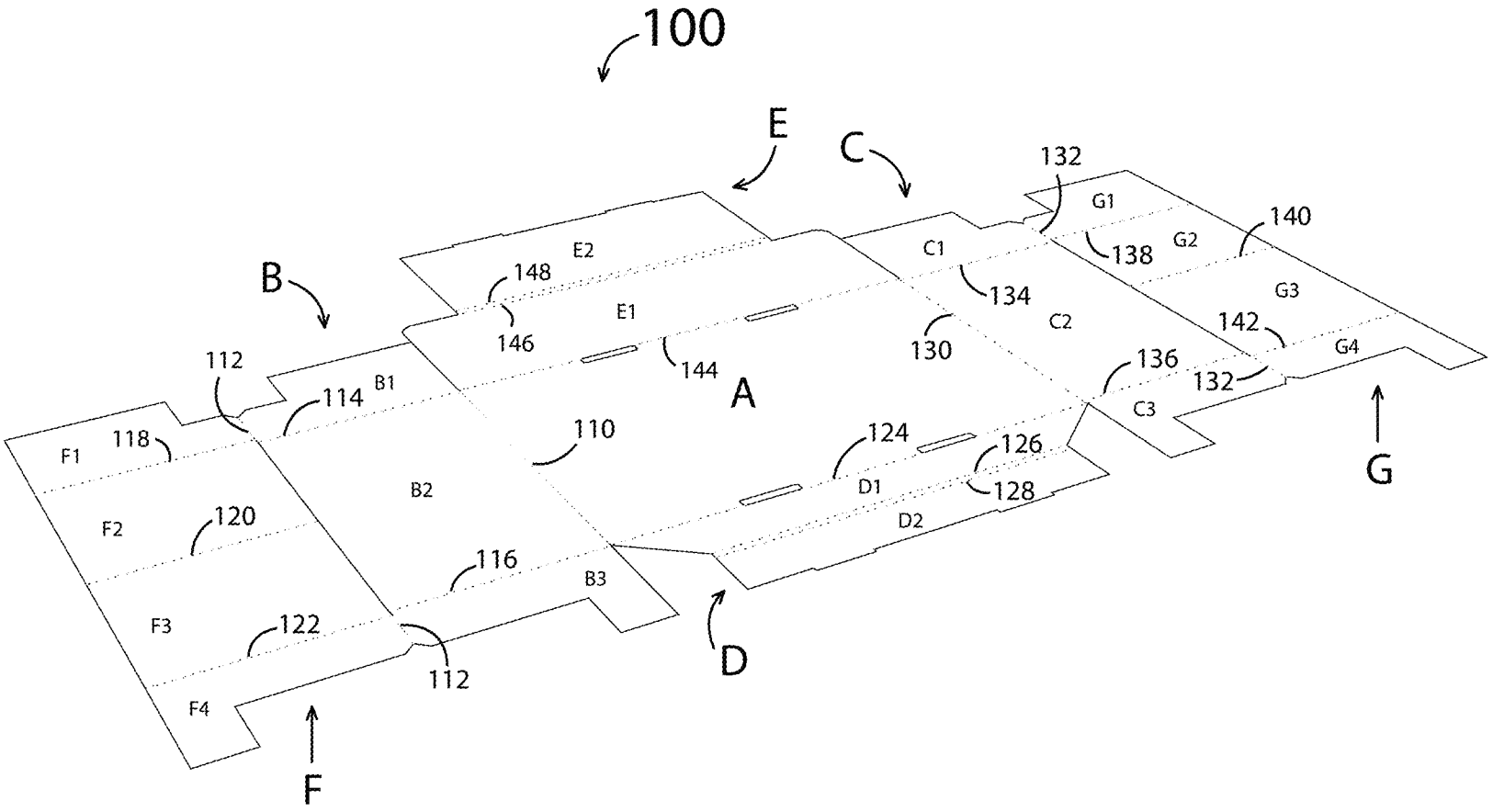
FIG. 2 is a perspective view of the blank of FIG. 1.

References to orientation, for example, top, bottom, front, rear, center, side, left, right, and the like, as may be used herein should be construed in a relative, rather than absolute, sense unless context clearly dictates otherwise.

Embodiments shown and described herein are illustrative and should not be construed as limiting the scope of the invention as defined by the appended claims. Features disclosed in connection with a given embodiment may be used in connection with any other embodiment to the greatest extent possible.

FIGS. 1-7 show a first embodiment of an illustrative one-piece, planar blank 100, a one-piece preassembly 102 made from the blank 100, and a container 104 erected from the preassembly 102 according to the present disclosure.

The blank 100 may be made of corrugated paperboard, card stock, or another suitable material. The blank 100 includes a bottom panel A, first and second (or left and right) combination panels B, C, first and second (or front and rear) wall panels D, E, and first and second (or left and right) auxiliary panels F, G. Solid lines between adjacent panels as shown in the drawings indicate separation of the adjacent panels from each other. Such separation may be effected, for example, by lancing, shearing, die cutting, or other means that may or may not yield a kerf. Dashed lines as shown in the drawings indicate fold lines that may or may not be scored. Scoring, where provided, may be effected by perforating or creasing the blank 100.

The first combination panel B is connected to the bottom panel A along a first fold line 110. The first fold line 110 and other fold lines described herein may be scored, for example, as discussed above. The first auxiliary panel F is connected to the first auxiliary B along a second fold line 112 parallel to the first fold line 110.

The first combination panel B includes a first (or rear) portion B1, a second (or center) portion B2, and a third (or front) portion B3. The center portion B2 is connected to the bottom panel A along the first fold line 110. The rear portion B1 is connected to the center portion B2 along a third fold line 114 perpendicular to the first fold line 110. The front portion B3 is connected to the center portion B2 along a fourth fold line 116 parallel to the third fold line 114.

The first auxiliary panel F includes a first (or rear) portion F1, a second (or rear center) portion F2, a third (or front center) portion F3, and a fourth (or front) portion F4. The rear portion F1 of the first auxiliary panel F is connected to the rear portion B1 of the first combination panel B along the second fold line 112. Similarly, the front portion F4 of the first auxiliary panel F is connected to the front portion B3 of the first combination panel B along the second fold line 112.

The rear portion F1 of the first auxiliary panel F is connected to the rear center portion F2 of the first auxiliary panel F along a fifth fold line 118 parallel to the third fold line 114. The rear center portion F2 is connected to the front center portion F3 along a sixth fold line 120 parallel to the third fold line 114. The front center portion F3 is connected to the front portion F4 along a seventh fold line 122 parallel to the third fold line 114. The sixth fold line 120 may be (but need not be) located midway between the fifth fold line 118 and the seventh fold line 122.

The first wall panel D includes a first portion D1 and a second portion D2. The first portion D1 is connected to the bottom panel A along an eighth fold line 124. The second portion D2 is connected to the first portion D1 along a ninth fold line 126 parallel to the eighth fold line 124 and along an optional first auxiliary fold line 128 parallel to the ninth fold line. Where provided, the second auxiliary fold line 128 facilitates the folding of the second portion D2 with respect to the first portion D1 when the preassembly 102 is formed into the container 104.

The second combination panel C is connected to the bottom panel A along a tenth fold line 130. The second auxiliary panel G is connected to the second combination panel C along an eleventh fold line 132.

The second combination panel C includes a first (or rear) portion C1, a second (or center) portion C2, and a third (or front) portion C3. The rear portion C1 is connected to the center portion C2 along a twelfth fold line 134 perpendicular to the tenth fold line 130. The front portion C3 is connected to the center portion C2 along a thirteenth fold line 136 parallel to the twelfth fold line 134.

The second auxiliary panel G includes a first (or rear) portion G1, a second (or rear center) portion G2, a third (or front center) portion G3, and a fourth (or front) portion G4. The rear portion G1 of the second auxiliary panel G is connected to the rear portion G1 of the second combination panel C along the eleventh fold line 132. Similarly, the front portion G4 of the second auxiliary panel G is connected to the front portion C3 of the second combination panel C along the eleventh fold line 132.

The rear portion G1 of the second auxiliary panel G is connected to the rear center portion G2 of the first auxiliary panel G along a fourteenth fold line 138 parallel to the twelfth fold line 134. The rear center portion G2 is connected to the front center portion G3 along a fifteenth fold line 140 parallel to the twelfth fold line 134. The front center portion G3 is connected to the front portion G4 along a sixteenth fold line 142 parallel to the twelfth fold line 134. The fifteenth fold line 140 may be (but need not be) located midway between the fourteenth fold line 138 and the sixteenth fold line 142.

The second wall panel E includes a first portion E1 and a second portion E2. The first portion E1 is connected to the bottom panel A along a seventeenth fold line 144. The second portion E2 is connected to the first portion E1 along an eighteenth fold line 146 parallel to the seventeenth fold line 144 and along an optional second auxiliary fold line 148 parallel to the eighteenth fold line. Where provided, the second auxiliary fold line 148 facilitates the folding of the second portion E2 with respect to the first portion E1 when the preassembly 102 is formed into the container 104.

As best shown in FIG. 1A, the fifth fold line 118 is offset from the third fold line 114 by a first predetermined distance S1 so that the fifth fold line 118 is directed through the first portion B1 of the first combination panel B. As best shown in FIG. 1B, the seventh fold line 122 is offset from the fourth fold line 116 by a second predetermined distance S2 so that the seventh fold line 122 is directed through the third portion B3 of the first combination panel B. The significance of the offsets shown in FIGS. 1A and 1B will be discussed further below.

Similarly, the fourteenth fold line 138 is offset from the twelfth fold line 134 by the first predetermined distance S1 or another predetermined distance so that the twelfth fold line 134 is directed through the first portion C1 of the second combination panel C, and the sixteenth fold line 142 is offset from the thirteenth fold line 136 by the second predetermined distance S2 or another predetermined distance so that the sixteenth fold line 142 is directed through the third portion C3 of the second combination panel C.

As best shown in FIG. 1C, the third fold line 114 may be (but need not be) offset from the seventeenth fold line 144 by a third predetermined distance S3 so that the third fold line 114 is directed through the bottom panel A. Such an offset may preclude interference between the first portion B1 of the first combination panel B and the second wall panel E when the preassembly 102 formed from the blank 100 is erected into the container 104, as will be discussed further below.

As best shown in FIG. 1D, the fourth fold line 116 may be (but need not be) offset from the eighth fold line 124 by a fourth predetermined distance S4 so that the fourth fold line 116 is directed through the bottom panel A. Such an offset may preclude interference between the third portion B3 of the first combination panel B and the first wall panel D when the preassembly 102 formed from the blank 100 is erected into the container 104, as will be discussed further below.

Similarly, and for similar reasons, the twelfth fold line 134 may be (but need not be) offset from the seventeenth fold line 144 by the third predetermined distance S3 or another predetermined distance so that the twelfth fold line 134 is directed through the bottom panel A, and the thirteenth fold line 136 may be (but need not be) offset from the eighth fold line 124 by the fourth predetermined distance S4 or another predetermined distance so that the thirteenth fold line 136 is directed through the bottom panel A.

The blank 100 defines first and second spaced-apart slots 150, 152 extending through the bottom panel A adjacent and parallel to the seventeenth fold line 144. The blank 100 also defines third and fourth spaced-apart slots 154, 156 extending through the bottom panel A adjacent and parallel to the eight fold line 124. The blank 100 further defines first and second tabs 158, 160 extending in a rearward direction from the rear edge of the second portion E2 of the second wall panel E. The blank 100 also defines third and fourth tabs 162, 164 extending in a forward direction from the front edge of the second portion D2 of the first panel D. Each of the slots 150, 152, 154, 156 has a length corresponding to and at least marginally greater than a length of the respective tab 158, 160, 162, 164, and a width corresponding to and at least marginally greater than a thickness of the respective tab 158, 160, 162, 164 (which may be the same as the thickness of the blank 100 generally), so that each of the tabs 158, 160, 162, 164 may be securely received within the corresponding slot 150, 152, 154, 156 when the blank 100 is erected into the container 104, as discussed further below.

Figure 3:
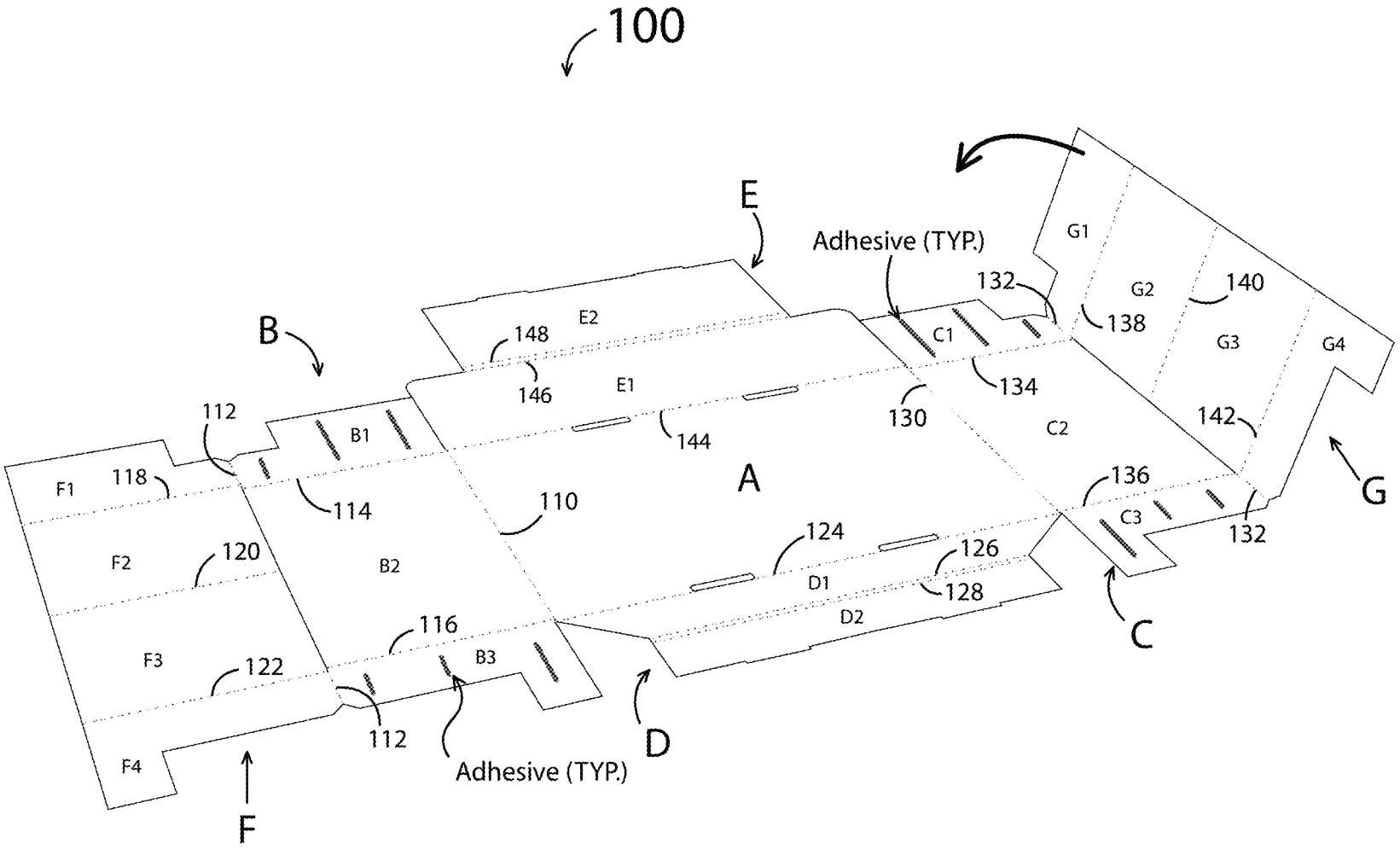
FIG. 3 is a perspective view of the blank of FIG. 1 being manipulated to form a preassembly according to the present disclosure.
Figure 4:
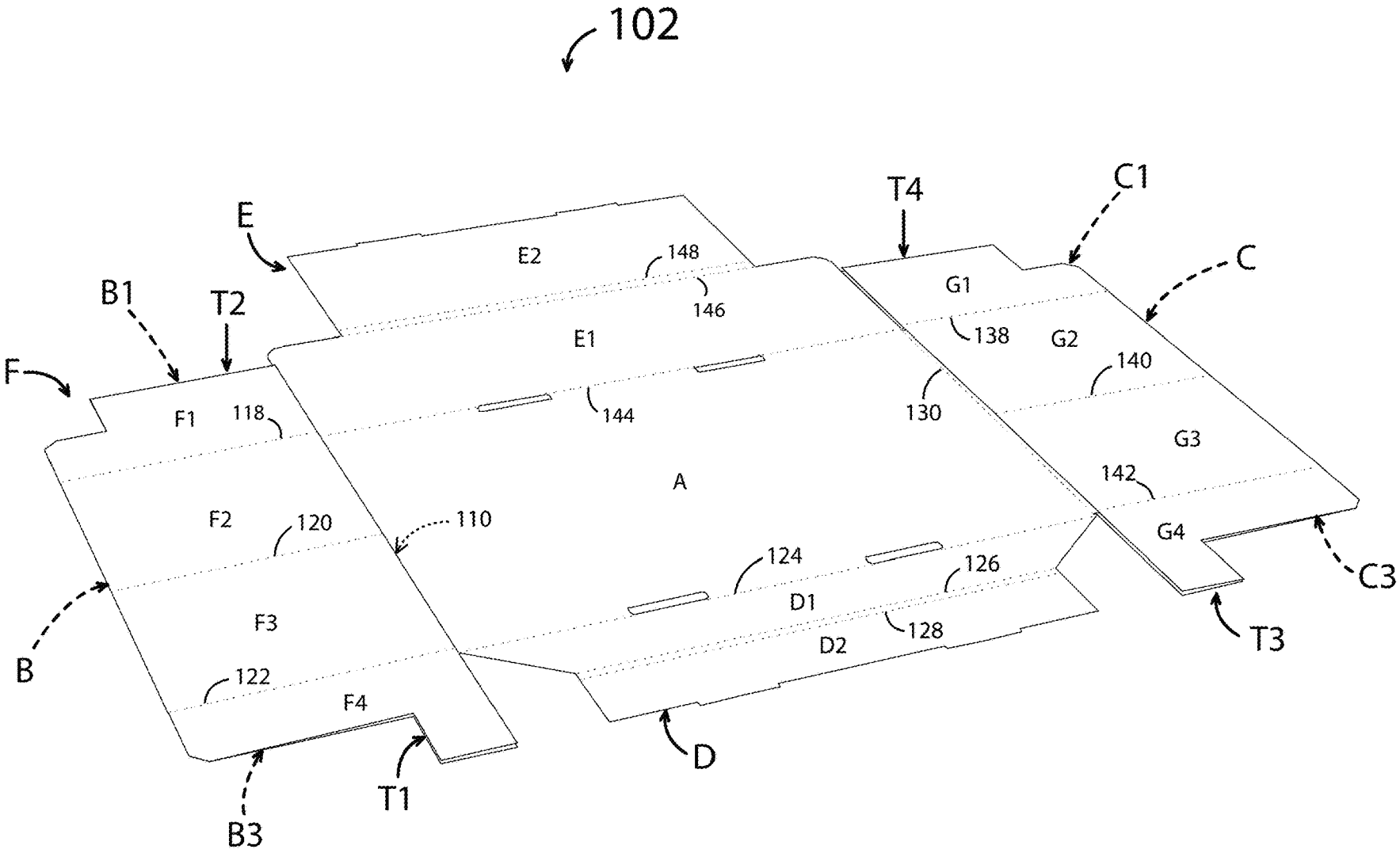
FIG. 4 is a perspective view of a preassembly formed from the blank of FIG. 1.

With reference to FIGS. 3 and 4, the preassembly 102 may be formed from the blank 100 as follows. Optionally, adhesive, for example, hot or cold glue, double sided tape, or the like, may be applied to one or both of the rear portion B1 of the first combination panel B and the rear portion F1 of the first auxiliary panel F. Also, adhesive optionally may be applied to one or both of the front portion B3 of the first combination panel B and the front portion F4 of the first auxiliary panel F. The first auxiliary panel F may be folded along the second fold line 112 against the first combination panel B. In embodiments using adhesive, the adhesive adheres the rear portion B1 of the first combination panel B to the rear portion F1 of the first auxiliary panel F, and the adhesive adheres the front portion B3 of the first combination panel B to the front portion F4 of the first auxiliary panel F.

Similarly, adhesive optionally may be applied to one or both of the rear portion C1 of the second combination panel C and the rear portion G1 of the second auxiliary panel G, and/or to one or both of the front portion C3 of the second combination panel C and the front portion G4 of the second auxiliary panel G. The second auxiliary panel G may be folded along the eleventh fold line 132 against the second combination panel C. In embodiments using adhesive, the adhesive adheres the rear portion C1 of the second combination panel C to the rear portion G1 of the second auxiliary panel G, and the adhesive adheres the front portion B3 of the second combination panel C to the front portion G4 of the second auxiliary panel G.

Figure 5:
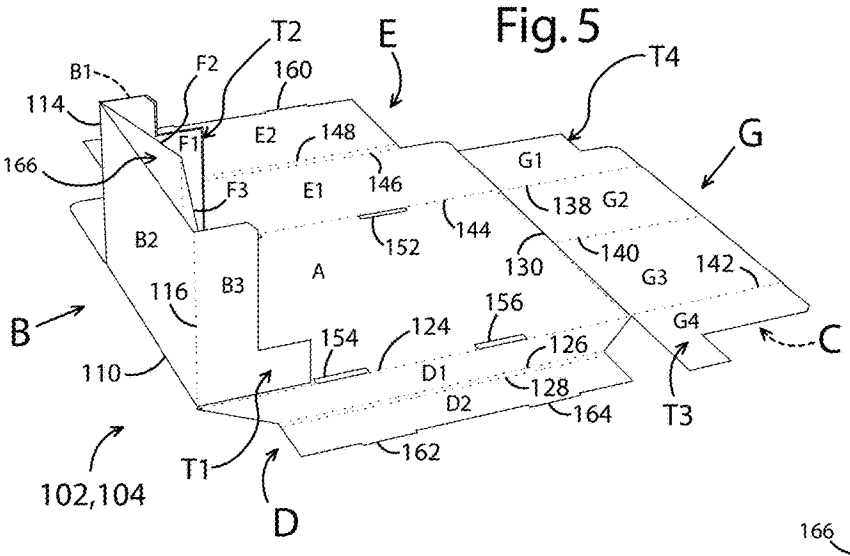
FIG. 5 is a perspective view of the preassembly of FIG. 4 partially erected into a container.

As best shown in FIGS. 4 and 5, the front portions B3, F4 of the first side panel B and the first auxiliary panel F cooperate to define a first tang T1, and rear portions B1, F1 of the first side panel B and the first auxiliary panel F of the preassembly 102 cooperate to define a second tang T2. Similarly, the front portions C3, G4 of the first side panel C and the second auxiliary panel G cooperate to define a third tang T3, and the rear portions C1, G1 of the second side panel C and the second auxiliary panel G cooperate to define a fourth tang T4.

Figure 6:
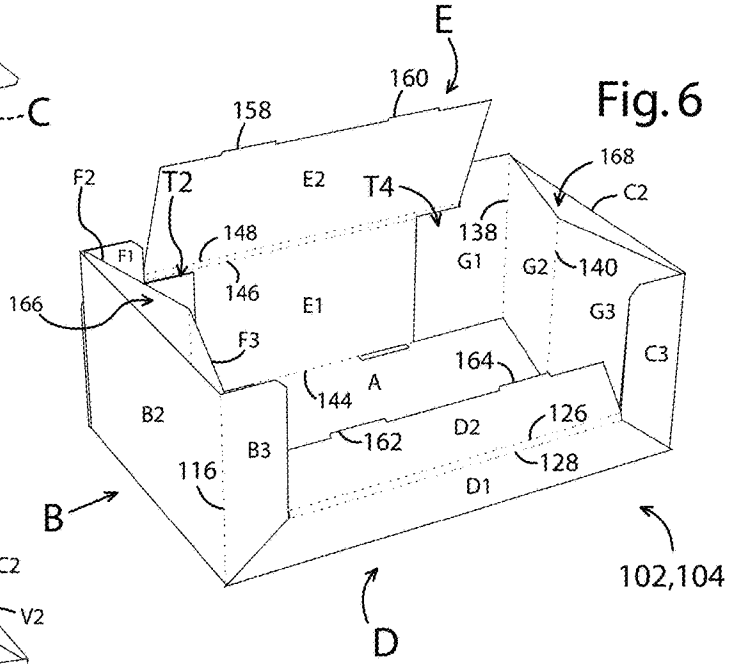
FIG. 6 is a perspective view of the preassembly of FIG. 4 further erected into a container.
Figure 7:
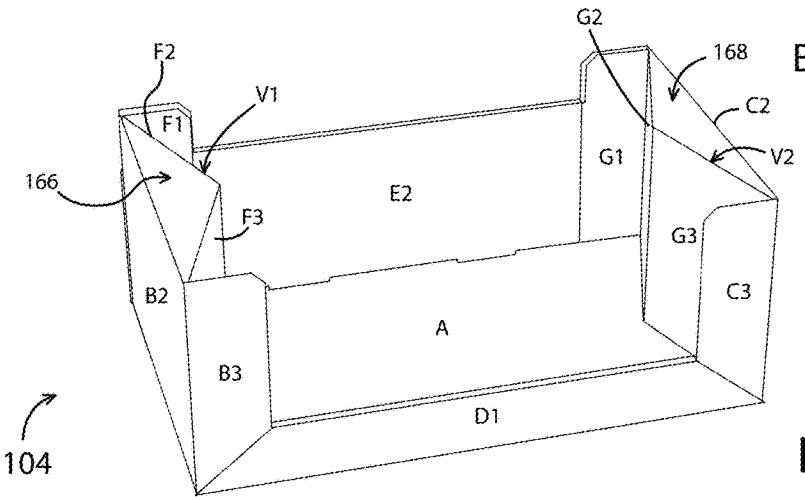
FIG. 7 is a perspective view of a container erected from the preassembly of FIG. 4.
Figure 8:
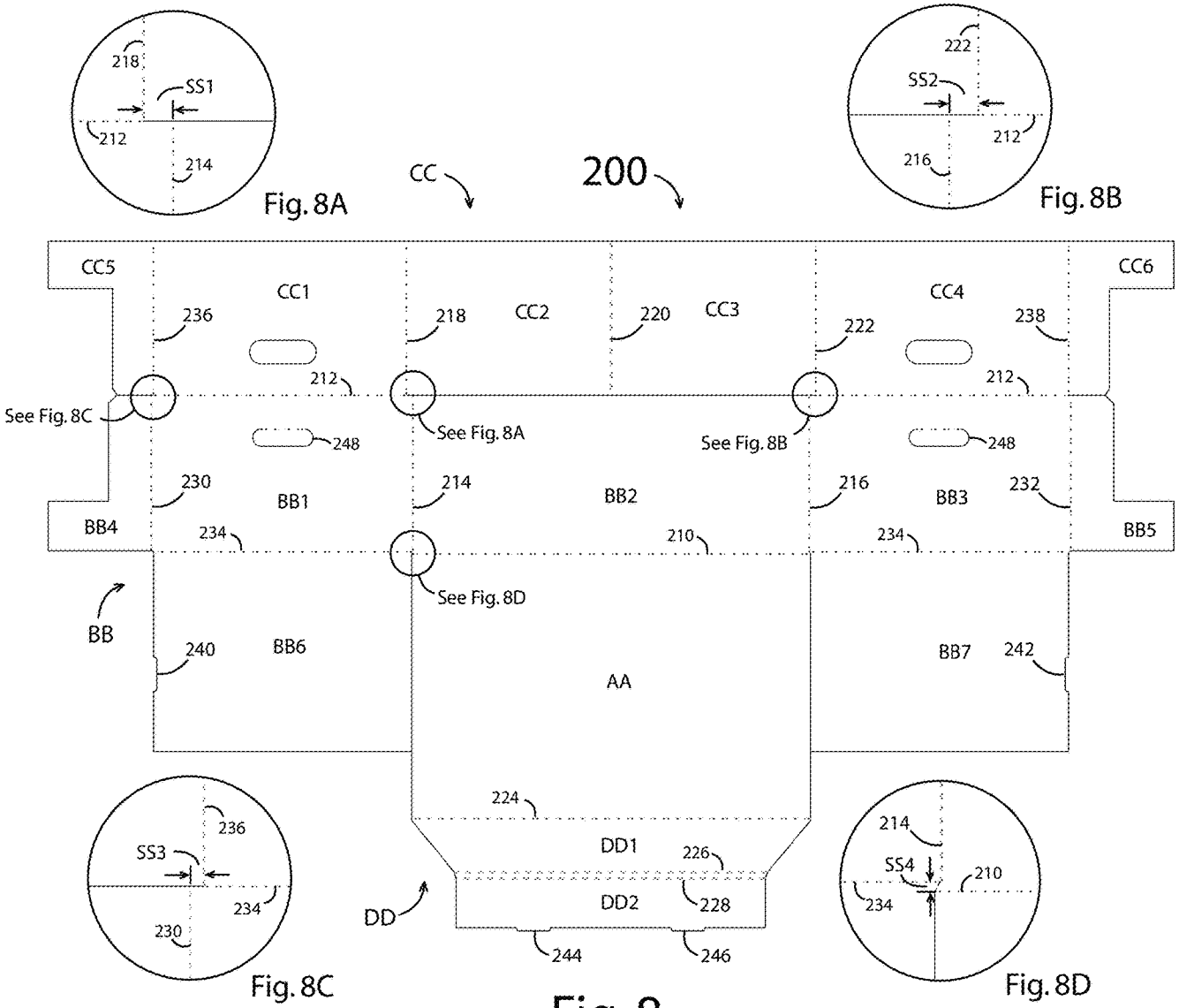
FIG. 8 is a plan view of an illustrative blank from which a second illustrative embodiment of a container may be erected according to the present disclosure.
Figure 9:
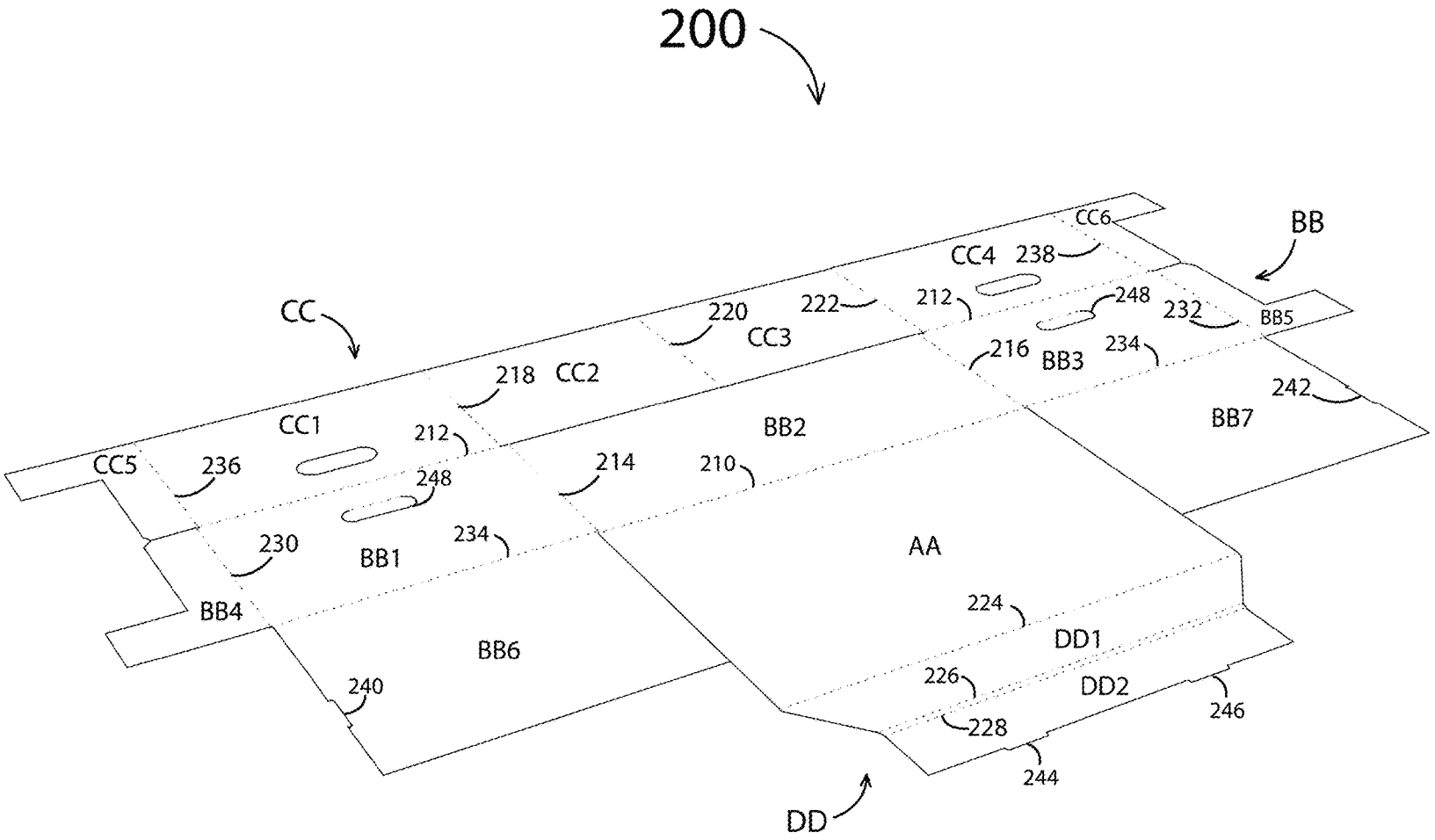
FIG. 9 is a perspective view of the blank of FIG. 8.

With reference to FIGS. 5-7, the preassembly 102 may be erected into the container 104 as follows. The first combination panel B may be folded about the first fold line 110 to a position perpendicular to the bottom panel A.

Also, the rear portion B1 of the first wall panel B may be folded about the third fold line 114 to a position perpendicular to the center portion B2 of the first wall panel, and the front portion B3 of the first wall panel B may be folded about the fourth fold line 116 to a position perpendicular to the center portion B2 of the first wall panel. Based on the relative locations of the third, fourth, fifth, and seventh fold lines 114, 116, 118, 122, the foregoing folding of the rear and front portions of the first wall panel B shortens the distance between the fifth and seventh fold lines 118, 122, thereby creating a compressive force on the rear center and front center portions F2, F3 of the first auxiliary panel F. This compressive force acts through the plane of the rear center and front center portions F2, F3 of the first auxiliary panel F and causes the rear center and front center portions F2, F3 of the first auxiliary panel F to buckle with respect to each other. The sixth fold line 120 connecting the rear center and front center portions F2, F3 functions as a line of relative weakness compared to the rest of the rear center and front center portions F2, F3. As such, folding the rear portion B1 of the first wall panel B about the third fold line 114 and folding the front portion B3 of the first wall panel B about the fourth fold line 116 automatically causes the rear center portion F2 of the first auxiliary panel F to fold with respect to the front center portion F3 of the first auxiliary panel about the sixth fold line 120.

Consequently, the rear center portion F2 and the front center portion F3 of the first auxiliary panel F change state from co-planar with each other to three-dimensional with respect to each other, thereby creating a first space 166 defined by the rear center portion F2 of the first auxiliary panel F, the front center portion F3 of the first auxiliary panel F, and the center portion B2 of the first wall panel B. The extent to which the rear center portion F2 and the front center portion F3 of the first auxiliary panel F change state from co-planar with each other to three-dimensional with respect to each other is a function of the magnitude of the third and fourth predetermined distances S3, S4, as would be understood by one skilled in the art. The greater the magnitude of the third and fourth predetermined distances S3, S4, the further the rear center portion F2 and the front center portion F3 of the first auxiliary panel F change state from co-planar with each other to three-dimensional with respect to each other, and the larger the first space 166 becomes, when the preassembly 102 is manipulated as discussed above. Also, the greater the magnitude of the third and fourth predetermined distances S3, S4, the further the sixth fold line 138 is displaced toward the tenth fold line 130 when the preassembly 102 is manipulated as discussed above.

The second combination panel C may be manipulated in an analogous manner to achieve an analogous effect. Consequently, the rear center portion G2 and the front center portion G3 of the second auxiliary panel G change state from co-planar with each other to three-dimensional with respect to each other, thereby creating a second space 168 defined by the rear center portion G2 of the second auxiliary panel G, the front center portion G3 of the second auxiliary panel G, and the center portion C2 of the second wall panel C.

The first portion D1 of the first wall panel D may be folded about the eighth fold line 124 to a position perpendicular to the bottom panel A. The second portion D2 of the first wall panel D may be folded about the ninth fold line 126 (and about the optional first auxiliary fold line 128, if provided), to a position parallel to the first portion D1 of the first wall panel D, thereby encompassing the first tang T1 and the third tang T3. The third and fourth tabs 162, 164 extending from the second portion D2 of the first wall panel D may be engaged, respectively, with the third and fourth slots 154, 156 defined by the bottom panel A, thereby securing the free end of the second portion D2 of the third wall panel D to the bottom panel A.

Similarly, the first portion E1 of the second wall panel E may be folded about the seventeenth fold line 144 to a position perpendicular to the bottom panel A. The second portion E2 of the fourth wall panel E may be folded about the eighteenth fold line 146 (and the optional second auxiliary fold line 148, if provided) to a position parallel to the first portion E1 of the fourth wall panel E, thereby encompassing the second tang T2 and the fourth tang T4. The first and second tabs 158, 160 extending from the outer edge of the outer portion E2 of the second wall panel E may be engaged, respectively, with the first and second slots 150, 152 defined by the bottom panel A, thereby securing the second portion E2 of the second wall panel E to the bottom panel A.

With the container 104 so erected, the rear center and front center portions F2, F3 of the first auxiliary panel F and the rear center and front center portions G2, G3 of the second auxiliary panel G define first and second V-shaped internal support structures V1, V2 capable of supporting another container 104 thereupon. The first and second internal support structures V1, V2 may cooperate with the first, second, third, and fourth wall panels B, C, D, E of the container 104 to support the another container 104. The free edges of the rear center and front center portions F2, F3 of the first auxiliary panel F and the rear center and front center portions G2, G3 of the second auxiliary panel G may receive a vertical load from the another container 104 thereupon and transfer the load to the bottom panel A of the container 104.

FIGS. 8-14 show a second embodiment of an illustrative one-piece, planar blank 200, a one-piece preassembly 202 made from the blank 200, and a container 204 erected from the preassembly 202 according to the present disclosure.

The blank 200 may be made of corrugated paperboard, card stock, or another suitable material. The blank 200 includes a bottom panel AA, a combination panel BB, an auxiliary panel CC, and a (front) wall panel DD. Solid lines between adjacent panels as shown in the drawings indicate separation of the adjacent panels from each other. Such separation may be effected, for example, by lancing, shearing, die cutting, or other means that may or may not yield a kerf. Dashed lines as shown in the drawings indicate fold lines that may or may not be scored. Scoring, where provided, may be effected by perforating or creasing the blank 200.

The combination panel BB is connected to the bottom panel AA along a first fold line 210. The auxiliary panel CC is connected to the combination panel BB along a second fold line 212 parallel to the first fold line 210.

The combination panel BB includes a first (or left wall) portion BB1, a second (or rear wall) portion BB2, a third (or right wall) portion BB3, a fourth (or left return) portion BB4, a fifth (or right return) portion BB5, a sixth (or left bottom) portion BB6, and a seventh (or right bottom) portion BB7. The rear wall portion BB2 is connected to the bottom panel AA along the first fold line 210. The left wall portion BB1 is connected to the rear wall portion BB2 along a third fold line 214 perpendicular to the first fold line 210. The right wall portion BB3 is connected to the rear wall portion BB2 along a fourth fold line 216 parallel to the third fold line 214. The left return portion BB4 is connected to the left wall portion BB1 along a tenth fold line 230 parallel to the third fold line 214. The right return portion BB5 is connected to the right wall portion BB3 along an eleventh fold line 232 parallel to the fourth fold line 216. The left bottom portion BB6 is connected to the left wall portion BB1 along a twelfth fold line 234 parallel to the first fold line 210. The right bottom portion BB7 is connected to the right wall portion BB4 along the twelfth fold line 234.

The auxiliary panel CC includes a first (or left wall) portion CC1, a second (or left rear) portion CC2, a third (or right rear) portion CC3, a fourth (or right wall) portion CC4, a fifth (or left return) portion CC5, and a sixth (or right return) portion CC6. The left wall portion CC1 of the auxiliary panel CC is connected to the left wall portion BB1 of the combination panel BB along the second fold line 212. The right wall portion CC3 of the auxiliary panel CC is connected to the right wall portion BB3 of the combination panel BB along the second fold line 212.

The left wall portion CC1 of the auxiliary panel CC is connected to the left rear portion CC2 thereof along a fifth fold line 218 perpendicular to the second fold line 212. The left rear portion CC2 of the auxiliary panel CC is connected to the right rear portion CC3 thereof along a sixth fold line 220 parallel to the fifth fold line 218. The right rear portion CC3 of the auxiliary panel CC is connected to the right wall portion CC4 thereof by a seventh fold line 222 parallel to the fifth fold line 218. The sixth fold line 220 may be located midway between the fifth and seventh fold lines 218, 222. The left return portion CC5 of the auxiliary panel CC is connected to the left wall portion CC1 thereof by a thirteenth fold line 236 parallel to the fifth fold line 218. The right return portion CC6 of the auxiliary panel CC is connected to the right wall portion CC3 thereof by a fourteenth fold line 238 parallel to the fifth fold line 218.

As best shown in FIG. 8A, the fifth fold line 218 is offset from the third fold line 214 by a first predetermined distance SS1. The fifth fold line 218 may be located outboard of the center section BB2 of the combination panel BB so that the fifth fold line is directed through the left wall section BB1. As best shown in FIG. 8B, the seventh fold line 222 is offset from the fourth fold line 216 by a second predetermined distance SS2 that may be, but need not be, the same as the first predetermined distance SS1. The seventh fold line 222 may be located outboard of the center portion BB2 of the combination panel BB so that the seventh fold line is directed through the right wall portion BB3. The significance of the offsets shown in FIGS. 8A and 8B will be discussed further below.

As best shown in FIG. 8C, the tenth fold line 230 is offset from the thirteenth fold line 236 by a third predetermine distance SS3. The tenth fold line 230 may be located outboard of the left wall portion CC1 of the auxiliary panel so that the tenth fold line is directed through the left return portion CC5. Such an offset may facilitate the folding of the left return portion BB4 of the combination panel BB with respect to the left wall portion BB1 of the combination panel and the folding of the left return portion CC5 the auxiliary panel CC with respect to the left wall portion CC1 of the auxiliary panel when the preassembly 202 formed from the blank 200 is erected into the container 204, as will be discussed further below. The eleventh fold line 232 may be similarly offset from the fourteenth fold line 238 so that the eleventh fold line is directed through the right return portion CC6, with a similar effect.

As best shown in FIG. 8D, the fourteenth fold line 234 may be offset from the first fold line 210 by a fourth predetermined distance SS4. The fourteenth fold line 234 may be located outboard of the bottom panel AA so that the fourteenth fold line is directed through the center return portion BB2 of the combination panel BB. Such an offset may preclude interference between the left bottom portion BB6 and the right bottom portion BB7 of the combination panel BB with respect to the bottom panel AA when the preassembly 202 formed from the blank 200 is erected into the container 204, as will be discussed further below.

The front wall panel DD includes a first portion DD1 and a second portion DD2. The first portion DD1 is connected to the bottom panel AA along an eighth fold line 224 parallel to the first fold line 210. The second portion DD2 is connected to the first portion DD1 along a ninth fold line 226 parallel to the eighth fold line 224 and along an optional auxiliary fold line 228 parallel to the eighth fold line. Where provided, the auxiliary fold line 228 facilitates the folding of the second portion DD2 with respect to the first portion DD1 when the preassembly 202 is formed into the container 204, as discussed further below.

The left bottom portion BB6 of the combination panel BB defines a first notch 240 inset from the left free edge thereof. Similarly, the right bottom portion BB7 defines a second notch 242 inset from the right free edge thereof. The blank 200 also defines first and second spaced-apart tabs 244, 246 extending in a forward direction from the forward edge of the second portion DD2 of the front wall panel DD. Each of the notches 240, 242 has a length corresponding to and at least marginally greater than a length of the respective tab 244, 246, and a width corresponding to a thickness of the respective tab 244, 246 (which may be the same as the thickness of the blank 200 generally) so that each of the tabs 244, 246 may be securely received within the corresponding notch 240, 242 when the blank 200 is erected into the container 204, as discussed further below.

Optionally, the blank 200 may define openings 248 in each of the left and right wall portions BB1, BB3 of the combination panel BB and the left and right wall portions CC1, CC4 of the auxiliary panel CC. Where provided, the openings 248 are located so that the openings 248 in the left wall portions BB1, CC1 become superimposed with each other and so that the openings 248 in the right wall portions BB3, CC4 become superimposed with each other when the blank 200 is manipulated to form the preassembly 202.

Figure 10:
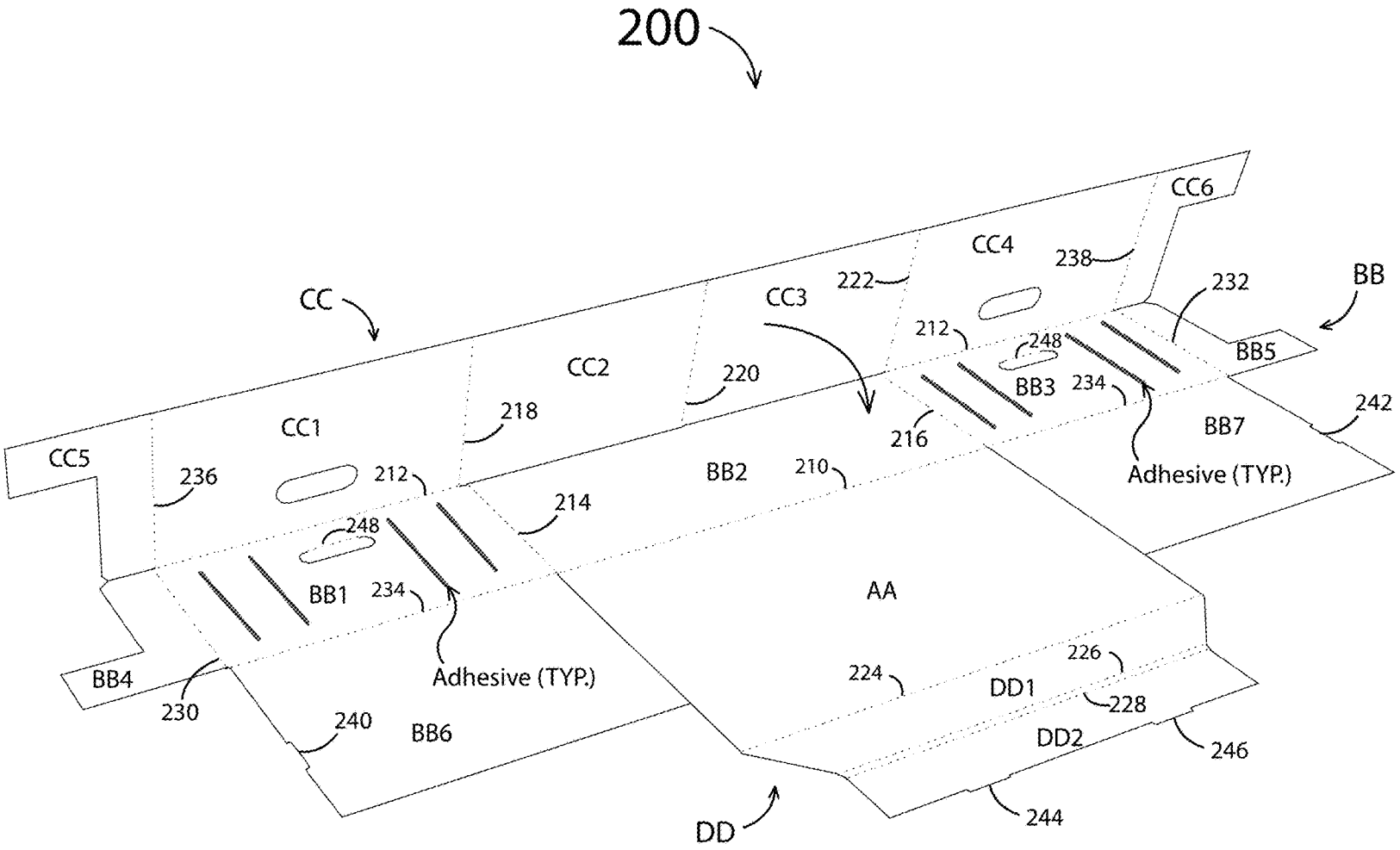
FIG. 10 is a view of the blank of FIG. 10 being manipulated to form a preassembly according to the present disclosure.
Figure 11:
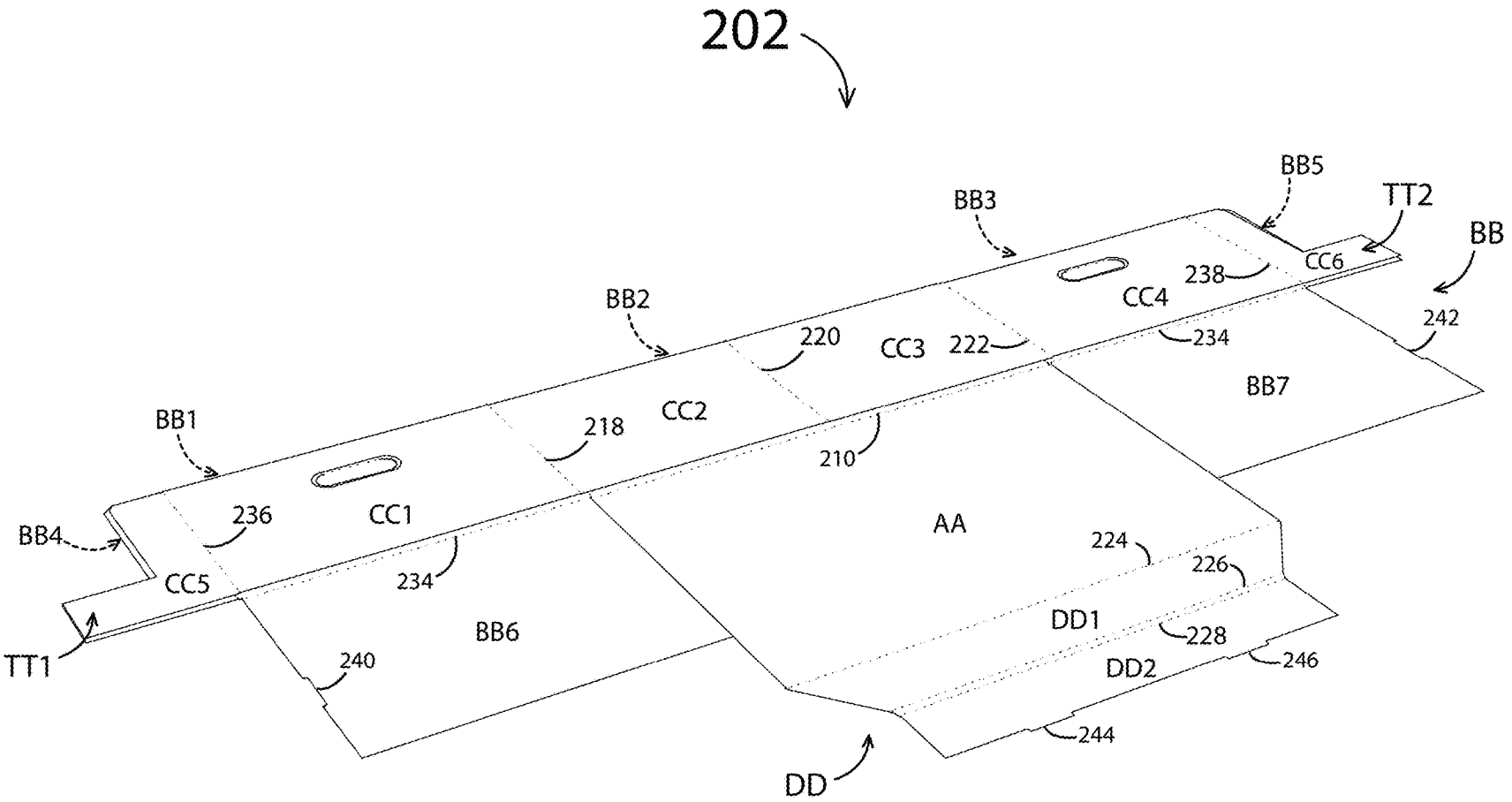
FIG. 11 is a view of a preassembly formed from the blank of FIG. 10.

With reference to FIGS. 10 and 11, the preassembly 202 may be formed from the blank 200 as follows. Adhesive, for example, hot or cold glue, double sided tape, or the like, optionally may be applied to one or both of the left wall portion BB1 of the combination panel BB and the left wall portion CC1 of the auxiliary panel CC, and also optionally to one or both of the right wall portion BB3 of the combination panel B and the right wall portion CC4 of the auxiliary panel CC. The auxiliary panel CC may be folded along the second fold line 212 against the combination panel BB. In embodiments using adhesive, the adhesive adheres the left wall portion BB1 of the combination panel BB to the left wall portion CC1 of the auxiliary panel CC, and/or the adhesive adheres the right wall portion BB3 of the combination panel BB to the right wall portion CC4 of the auxiliary panel CC.

Figure 12:
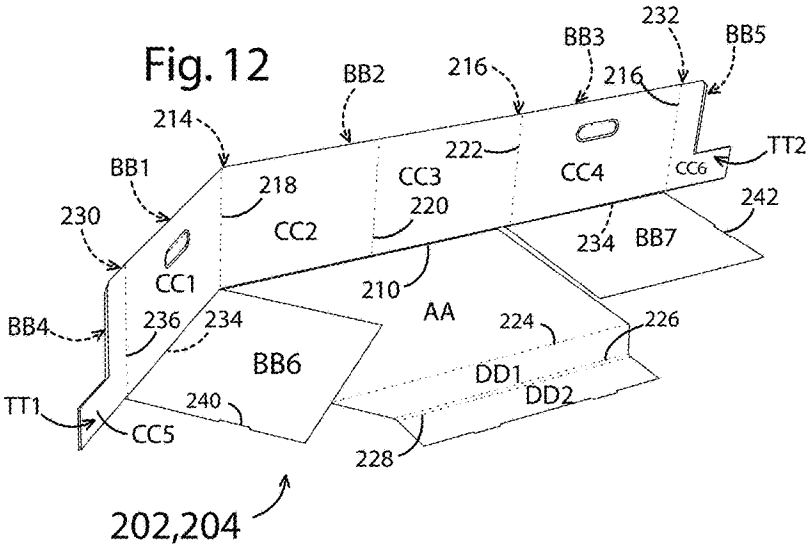
FIG. 12 is a view of the preassembly of FIG. 11 partially erected into a container.

As best shown in FIGS. 11 and 12, the left return portions BB4, CC5 of the combination panel BB and the auxiliary panel CC of the preassembly 202 cooperate to define a first tang TT1, and the right return portions BB5, CC6 of the combination panel BB and the auxiliary panel CC cooperate to define a second tang TT2.

Figure 13:
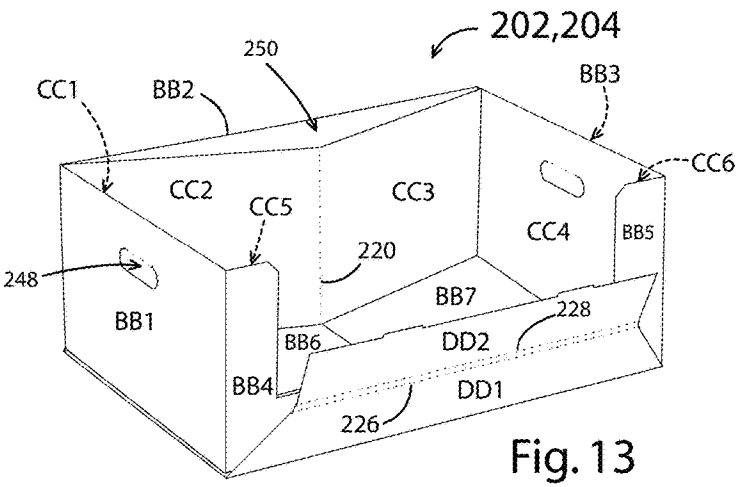
FIG. 13 is a view of the preassembly of FIG. 11 further erected into a container.
Figure 14:
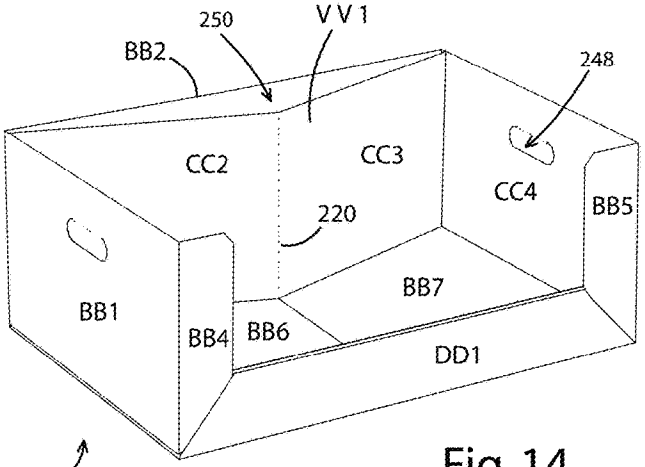
FIG. 14 is a view of a container erected from the preassembly of FIG. 11.
Figure 15:
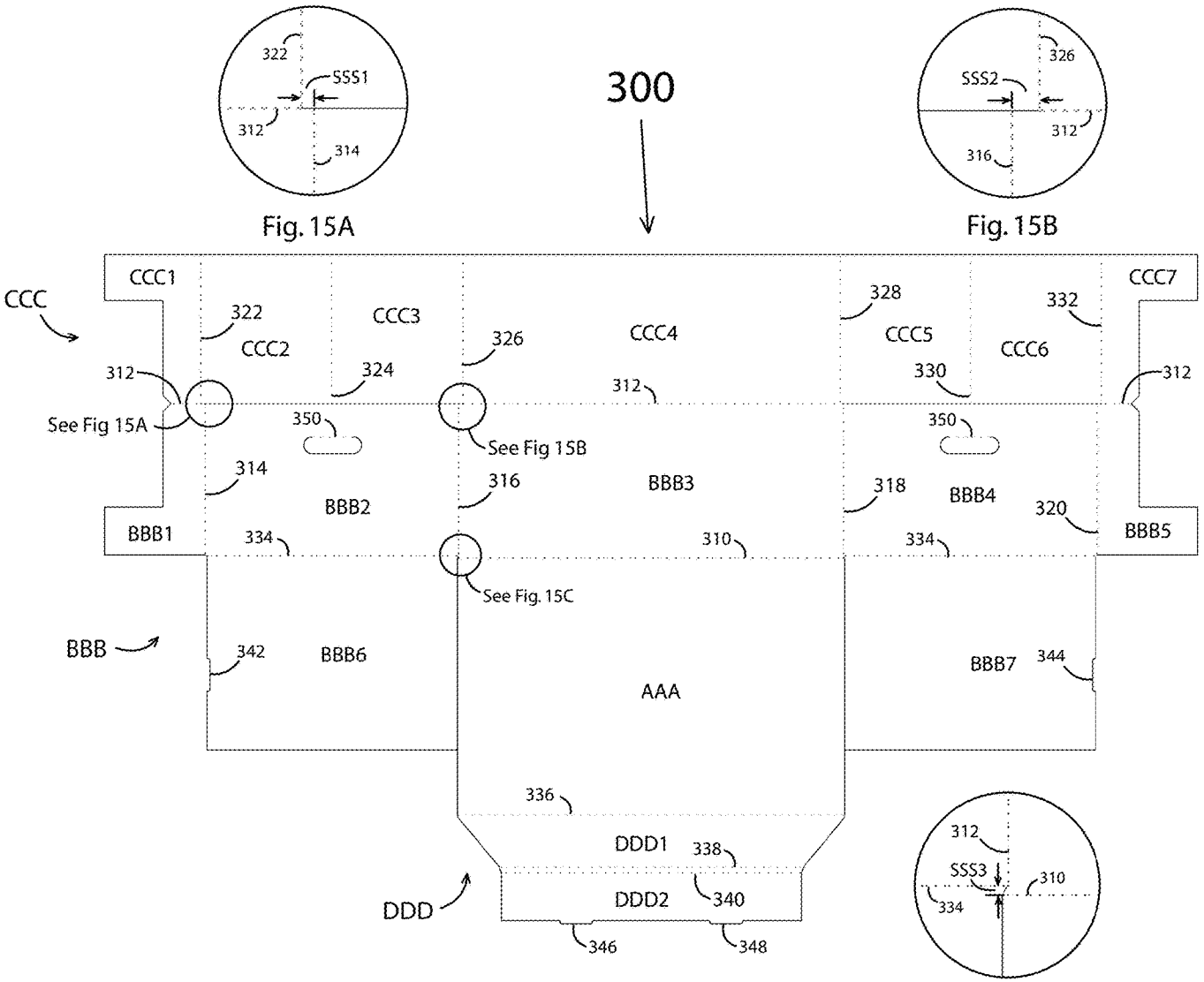
FIG. 15 is a plan view of an illustrative blank from which a third illustrative embodiment of a container may be erected according to the present disclosure.
Figure 16:
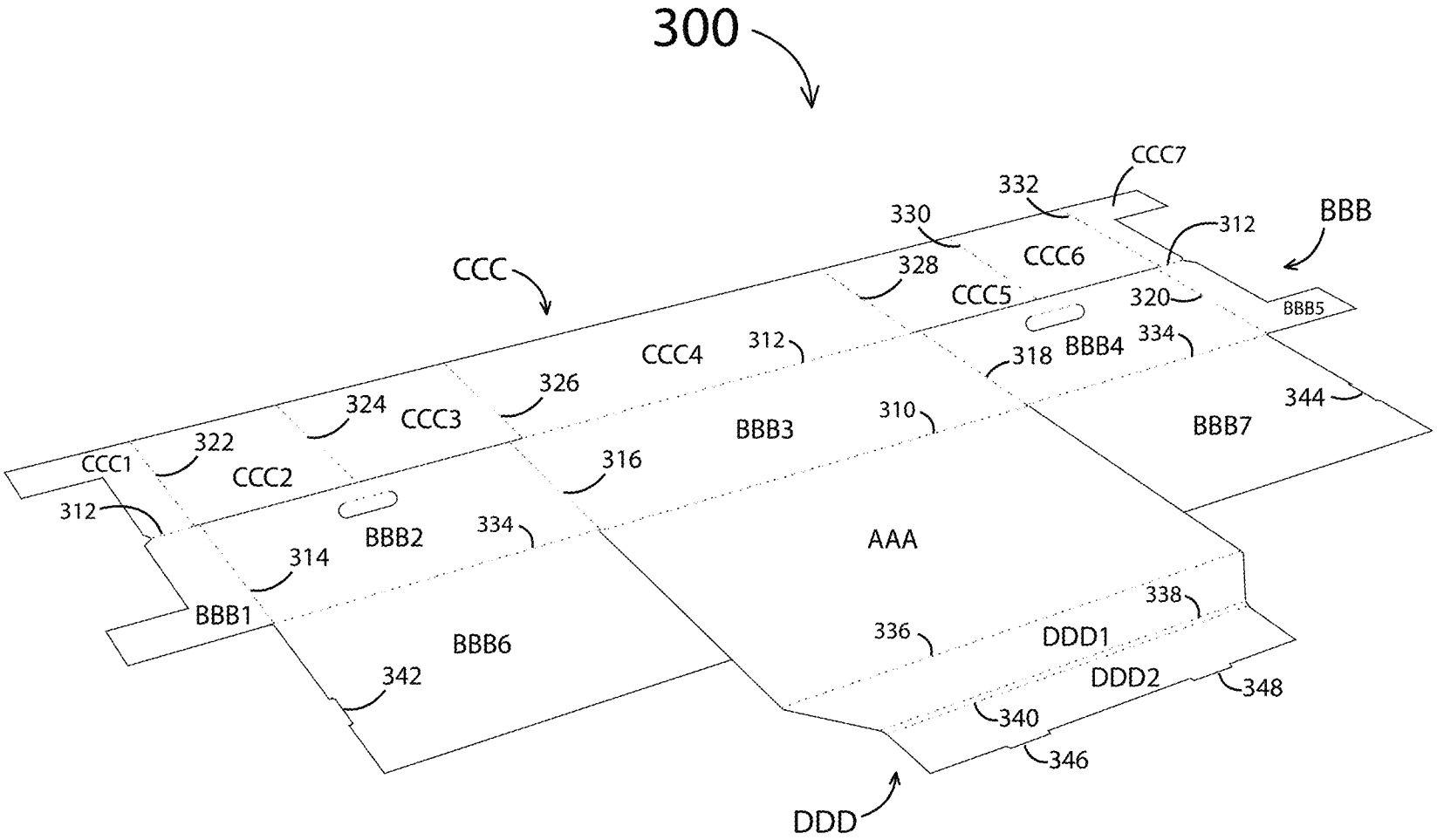
FIG. 16 is a perspective view of the blank of FIG. 15.

With reference to FIGS. 12-14, the preassembly 202 may be erected into the container 204 as follows. The center panel BB2 of the combination panel BB may be folded about the first fold line 210 to a position perpendicular to the bottom panel AA. Also, the left bottom panel BB6 of the combination panel BB may be folded about the fourteenth fold line 234 to a position perpendicular to the left wall panel BB1 of the combination panel BB, and the right bottom panel BB7 of the combination panel BB may be folded about the fourteenth fold line 234 to a position perpendicular to the right wall panel BB3 of the combination panel BB.

With continued reference to FIGS. 12-14, the left wall portion BB1 of the combination panel BB may be folded about the third fold line 214 to a position perpendicular to the center portion BB2 of the combination panel. Consequently, the left bottom portion BB6 of the combination panel BB may be placed atop and parallel to the bottom panel AA. Also, the right wall portion BB3 of the combination panel BB may be folded about the fourth fold line 216 to a position perpendicular to the center portion BB2 of the combination panel. Consequently, the right bottom portion BB7 of the combination panel BB may be placed atop and parallel to the bottom panel AA. The offset shown in FIG. 8D, if provided, may facilitate such placement of the left and right bottom portions BB6, BB7 atop the bottom panel AA.

Based on the relative locations of the third, fourth, fifth, and seventh fold lines 214, 216, 218, 222, the foregoing folding of the left and right wall portions BB1, BB3 of the combination panel BB shortens the distance between the fifth and seventh fold lines 218, 222, thereby creating a compressive force on the left center and right center portions CC2, CC3 of the auxiliary panel CC. This compressive force acts through the plane of the left center and right center portions CC2, CC3 of the auxiliary panel CC and causes the left center and rear center portions CC2, CC3 of the auxiliary panel CC to buckle with respect to each other. The sixth fold line 220 connecting the left center and rear center portions CC2, CC3 functions as a line of relative weakness compared to the rest of the left center and right center portions CC2, CC3. As such, folding the left wall portion BB1 of the combination panel BB about the third fold line 214 and folding the right wall portion BB3 of the combination panel BB about the fourth fold line 216 automatically causes the left center portion CC2 of the auxiliary panel CC to fold with respect to the right center portion CC3 of the auxiliary panel about the sixth fold line 220, so that the left center portion CC2 and the right center portion CC3 change state from co-planar with each other to three-dimensional with respect to each other, thereby creating a space 250 defined by the left and right center portions CC2, CC3 of the auxiliary panel CC and the center portion BB2 of the combination panel BB.

The extent to which the left and right center portions CC2, CC3 of the auxiliary panel CC change state from co-planar with each other to three-dimensional with respect to each other is a function of the magnitude of the first and second predetermined distances SS1, SS2, as would be understood by one skilled in the art. The greater the magnitude of the first and second predetermined distances SS1, SS2, the further the left and right center portions CC2, CC3 of the auxiliary panel CC change state from co-planar with each other to three-dimensional with respect to each other, and the larger the space 250 becomes, when the preassembly 202 is manipulated as discussed above. Also, the greater the magnitude of the first and second predetermined distances SS1, SS2, the further the sixth fold line 220 is displaced toward the eighth fold line 224 when the preassembly 202 is manipulated as discussed above.

The first portion DD1 of the front wall panel DD may be folded about the eighth fold line 224 to a position perpendicular to the bottom panel AA. The second portion DD2 of the front wall panel DD may be folded about the ninth fold line 226 (and about the optional auxiliary fold line 228, if provided), to a position parallel to the second portion DD2 of the front wall panel DD, thereby encompassing the first tang TT1 and the second tang TT2. The first and second tabs 244, 246 extending from the front wall panel DD may be engaged, respectively, with the first and second slots 240, 242 defined by the bottom panel AA, thereby securing the front wall panel DD to the bottom panel AA.

With the container 204 so erected, the left center and right center portions CC2, CC3 of the auxiliary panel CC define a V-shaped internal support structure VV1 capable of supporting a portion of another container 204 thereupon. The support structure VV1 may cooperate with the left wall portions BB1, CC1, right wall portions BB3, CC4, left return portions BB4, CC5, and right return portions BB5, CC6, respectively, of the combination and auxiliary panels BB, CC of the container 204 to support the another container 204. The free edges of the left rear and right rear portions CC2, CC3 of the auxiliary panel CC may receive a vertical load from the another container 204 thereupon and transfer the load to the bottom panel AA of the container 204.

In embodiments including them, the openings 248 may function as hand holds for the container 204.

FIGS. 15-21 show a third embodiment of an illustrative one-piece, planar blank 300, a one-piece preassembly 302 made from the blank 300, and a container 304 erected from the preassembly 302 according to the present disclosure.

The blank 300 may be made of corrugated paperboard, card stock, or another suitable material. The blank 300 includes a bottom panel AAA, a combination panel BBB, an auxiliary panel CCC, and a front wall panel DDD. Solid lines between adjacent panels as shown in the drawings indicate separation of the adjacent panels from each other. Such separation may be effected, for example, by lancing, shearing, die cutting, or other means that may or may not yield a kerf. Dashed lines as shown in the drawings indicate scoring. Such scoring may be effected by perforating or creasing the blank 300.

The combination panel BBB is connected to the bottom panel AAA along a first fold line 310. The auxiliary panel CCC is connected to the combination panel BBB along a second fold line 312 parallel to the first fold line 310.

The combination panel BBB includes a left return portion BBB1, a left wall portion BBB2, a rear wall portion BBB3, a right wall portion BBB4, a right return portion BBB5, a left bottom portion BBB6, and a right bottom portion BBB7. The rear wall portion BBB3 is connected to the bottom panel AAA by a first fold line 310. The left return portion BBB1 is connected to the left wall portion BBB2 by a third fold line 314 perpendicular to the second fold line 312. The left wall portion BBB2 is connected to the rear wall portion BBB3 by a fourth fold line 316 parallel to the third fold line 314. The rear wall portion BBB3 is connected to the right wall portion BBB4 by a fifth fold line 318 parallel to the third fold line 314. The right wall portion BBB4 is connected to the right return portion BBB5 by a sixth fold line 320 parallel to the third fold line 314. The left bottom portion BBB6 is connected to the left wall portion BBB2 by a thirteenth fold line 334 parallel to the first fold line 310. The right bottom portion BBB7 is connected to the right wall portion BBB4 by the thirteenth fold line 334.

The auxiliary panel CCC includes a left return portion CCC1, a left front portion CCC2, a left rear portion CCC3, a center portion CCC4, a right rear portion CCC5, a right front portion CCC6, and a right return portion CCC7. The left return portion CCC1 of the auxiliary panel CCC is connected to the left return portion BBB1 of the combination panel BBB by the second fold line 312. The center portion CCC4 of the auxiliary panel CCC is connected to the center portion BBB3 of the combination panel BBB by the second fold line 312. The right return portion CCC7 of the auxiliary panel CCC is connected to the right return portion BBB5 of the combination panel BBB by the second fold line 312.

The left return portion CCC1 of the auxiliary panel CC is connected to the left front portion CCC2 thereof by a seventh fold line 322 parallel to the third fold line 316. The left front portion CCC2 of the auxiliary panel CCC is connected to the left rear portion CCC3 thereof by an eighth fold line 324 parallel to the seventh fold line 322. The left rear portion CCC3 of the auxiliary panel CCC is connected to the center portion CCC4 thereof by a ninth fold line 326 parallel to the seventh fold line 322. The center portion CCC4 of the auxiliary panel CCC is connected to the right rear portion CCC5 thereof by a tenth fold line 328 parallel to the seventh fold line 322. The right rear portion CCC5 of the auxiliary panel CCC is connected to the right front portion CCC6 thereof by an eleventh fold line 330 parallel to the seventh fold line 322. The right front portion CCC6 of the auxiliary panel CCC is connected to the right return portion CCC7 thereof by a twelfth fold line 332 parallel to the seventh fold line 322.

As best shown in FIG. 15A, the seventh fold line 322 may be offset from the third fold line 314 by a first predetermined distance SSS1, as will be discussed further below. The seventh fold line 322 may be located outboard of the left wall portion BBB2 of the combination panel BBB so that the seventh fold line 322 is directed through the left return portion BBB1 of the combination panel. The twelfth fold line 332 may be similarly offset from the sixth fold line 320 by the first predetermined distance SSS1 or another suitable predetermined distance so that the twelfth fold line 332 is directed through the right return portion BBB5 of the combination panel BBB.

As best shown in FIG. 15B, the ninth fold line 326 may be offset from the fourth fold line 316 by a second predetermined distance SSS2, as will be discussed further below. The ninth fold line 326 may be located outboard of the left wall portion BBB2 of the combination panel BBB so that the seventh fold line 322 is directed through the center portion BBB3 of the combination panel. The tenth fold line 328 may be similarly offset from the fifth fold line 318 by the second predetermined distance SSS2 or another suitable predetermined distance so that the twelfth fold line 332 is directed through the center portion BBB3 of the combination panel BBB.

As best shown in FIG. 15C, the thirteenth fold line 334 is offset from the first fold line 310 by a third predetermined distance SSS3, as will be discussed further below. The thirteenth fold line 334 may be located inboard of the bottom panel AAA so that the thirteenth fold line 334 is directed through the rear wall portion BBB3 of the combination panel BBB. Such an offset may preclude interference between the left bottom portion BBB6 and the right bottom portion BBB7 of the combination panel BBB with respect to the bottom panel AAA when the preassembly 302 formed from the blank 300 is erected into the container 304, as will be discussed further below.

The front wall panel DDD includes a first portion DDD1 and a second portion DDD2. The first portion DDD1 is connected to the bottom panel AAA by a fourteenth fold line 336 parallel to the first fold line 310. The second portion DDD2 is connected to the first portion DDD1 by a fifteenth fold line 338 parallel to the first fold line 310 and by an optional first auxiliary fold line 340 parallel to the fifteenth fold line 338. Where provided, the first auxiliary fold line 340 facilitates the folding of the second portion DDD2 with respect to the first portion DDD1 when the preassembly 302 is formed into the container 304.

The left bottom panel BBB6 defines a first notch 342 inset from the left free edge thereof. Similarly, the right bottom panel BBB7 defines a second notch 344 inset from the right free edge thereof. The blank 300 also defines first and second spaced-apart tabs 346, 348 extending in a forward direction from the forward edge of the second portion DDD2 of the front wall panel DDD. Each of the notches 342, 344 has a length corresponding to and at least marginally greater than a length of the respective tab 346, 348, and a width corresponding to a thickness of the respective tab 346, 348 (which may be the same as the thickness of the blank 300 generally) so that each of the tabs 346, 348 may be securely received within the corresponding notch 342, 344 when the blank 300 is erected into the container 304, as discussed further below.

Optionally, the blank 300 may define openings 350 in each of the left and right wall portions BBB2, BBB4 of the combination panel BBB.

Figure 17:
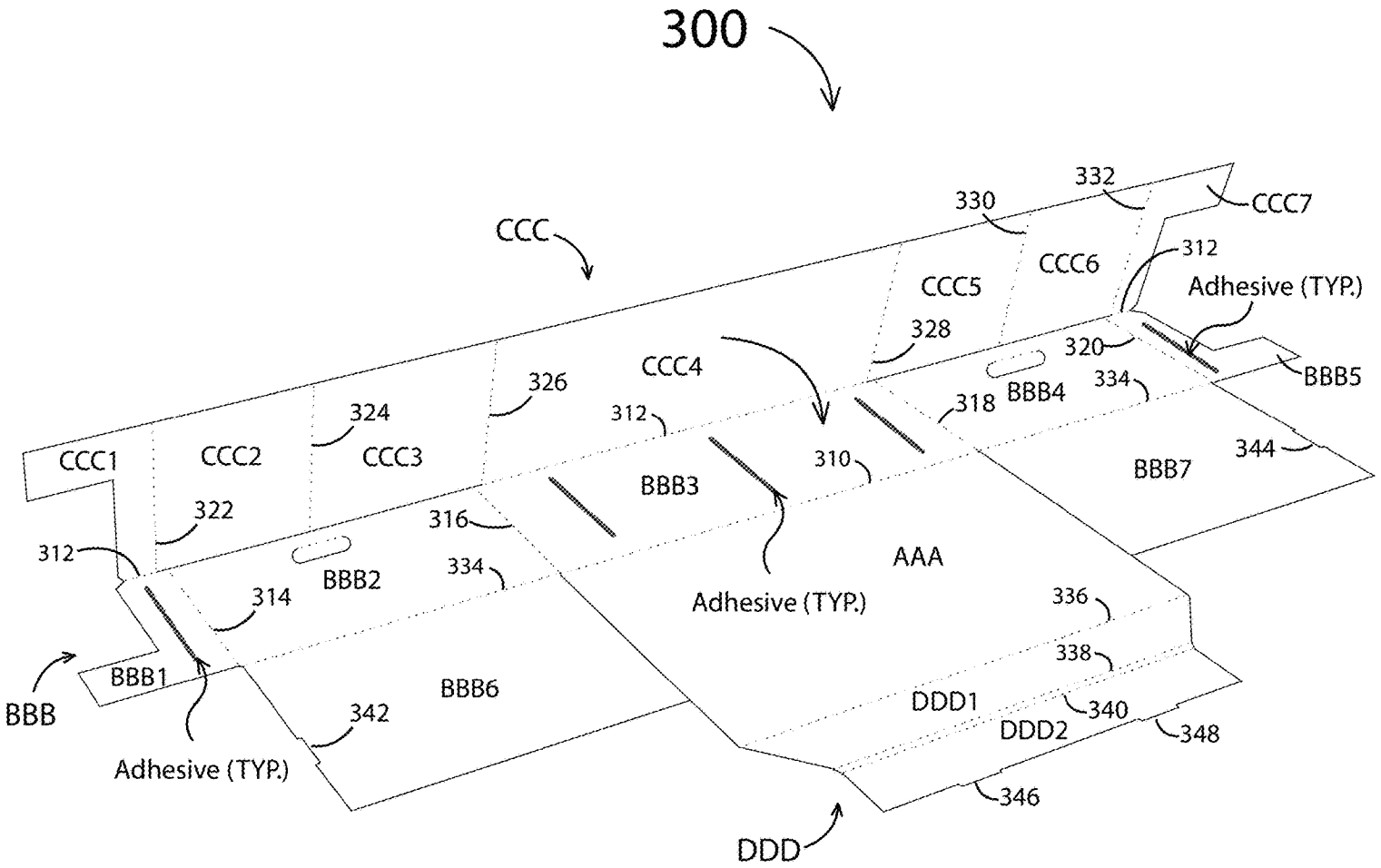
FIG. 17 is a view of the blank of FIG. 15 being manipulated to form a preassembly according to the present disclosure.
Figure 18:
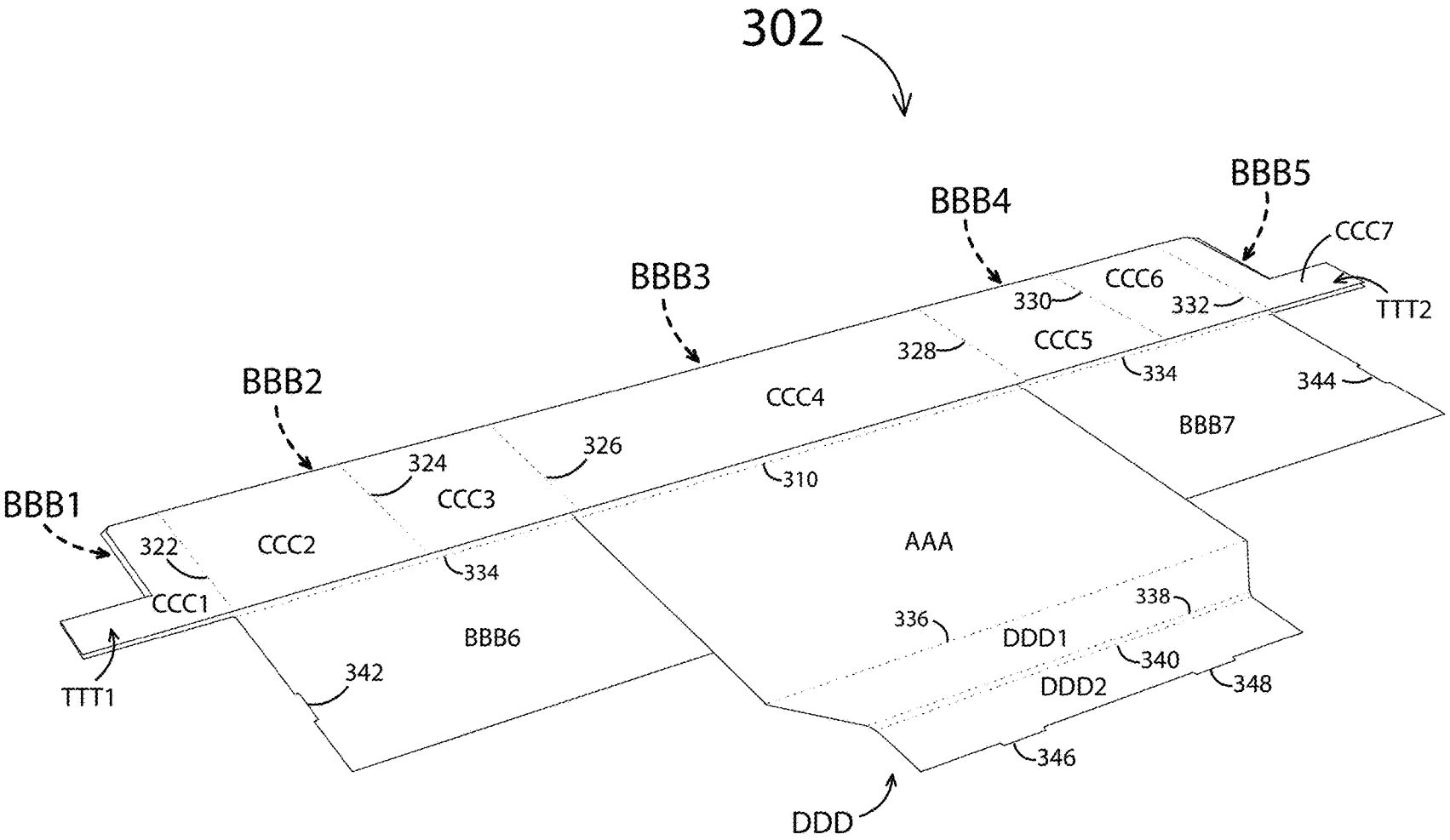
FIG. 18 is a view of a preassembly formed from the blank of FIG. 15.

With reference to FIGS. 17 and 18, the preassembly 302 may be formed from the blank 300 as follows. Adhesive, for example, hot or cold glue, double sided tape, or the like, optionally may be applied to one or both of the left return portion BBB1 of the combination panel BB and the left return portion CCC1 of the auxiliary panel CCC, optionally to one or both of the rear wall portion BBB3 of the combination panel BBB and the rear wall portion CCC4 of the auxiliary panel CCC, and optionally to one or both of the right return portion BBB5 of the combination panel BBB and the right return portion CCC7 of the auxiliary panel CCC. The auxiliary panel CCC may be folded along the second fold line 312 against the combination panel BBB. In embodiments using adhesive between the left return portion BBB1 of the combination panel BBB and the left return portion CCC1 of the auxiliary panel CCC, such adhesive adheres the left return portion BBB1 of the combination panel BBB to the left return portion CCC1 of the auxiliary panel CCC. In embodiments using adhesive between the rear wall portion BBB3 of the combination panel BBB and the rear wall portion CCC4 of the auxiliary panel CCC, such adhesive adheres the rear wall portion BBB3 of the combination panel BBB to the rear wall portion CCC4 of the auxiliary panel CCC. In embodiments using adhesive between the right return portion BBB5 of the combination panel BBB and the right return portion CCC7 of the auxiliary panel CCC, such adhesive adheres the right return portion BBB5 of the combination panel BBB to the right return portion CCC7 of the auxiliary panel CCC.

As best shown in FIGS. 18 and 19, the left return portions BBB1, CCC1 of the combination panel BBB and the auxiliary panel CCC of the preassembly 302 cooperate to define a first tang TTT1, and the right return portions BBB5, CCC7 of the combination panel BBB and the auxiliary panel CCC cooperate to define a second tang TTT2.

With reference to FIGS. 19-21, the preassembly 302 may be erected into the container 304 as follows. The center panel BBB3 of the combination panel BBB may be folded about the first fold line 310 to a position perpendicular to the bottom panel AAA. Also, the left bottom panel BBB6 of the combination panel BBB may be folded about the thirteenth fold line 334 to a position perpendicular to the left wall panel BBB2 of the combination panel BBB, and the right bottom panel BBB7 of the combination panel BBB may be folded about the thirteenth fold line 334 to a position perpendicular to the right wall panel BBB4 of the combination panel BBB.

With continued reference to FIGS. 19-21, the left wall portion BBB2 of the combination panel BBB may be folded about the fourth fold line 316 to a position perpendicular to the center portion BBB3 of the combination panel. Consequently, the left bottom portion BBB6 of the combination panel BBB may be placed atop and parallel to the bottom panel AAA. Also, the right wall portion BBB4 of the combination panel BBB may be folded about the fifth fold line 318 to a position perpendicular to the center portion BBB3 of the combination panel. Consequently, the right bottom portion BBB7 of the combination panel BBB may be placed atop and parallel to the bottom panel AAA. The offset shown in 15C, if provided, may facilitate such placement of the left and right bottom portions of the combination panel BBB atop the bottom panel AAA.

Also, the left return portion BBB1 of the combination panel BBB may be folded about the third fold line 314 to a position perpendicular to the left wall portion BBB2 of the combination panel, and the right return portion BBB5 of the combination panel BBB may be folded about the sixth fold line 320 to a position perpendicular to the right wall portion BBB3 of the combination panel.

Based on the relative locations of the third, fourth seventh, and ninth fold lines 314, 316, 322, 326, the foregoing folding of the left return portion BBB1 of the bottom panel BBB and the foregoing folding of the left wall portions BBB2 of the combination panel BB shortens the distance between the seventh and ninth fold lines 322, 326, thereby creating a compressive force on the left front and left rear portions CCC2, CCC3 of the auxiliary panel CCC. This compressive force acts through the plane of the left front and left rear portions CCC2, CCC3 of the auxiliary panel CCC and causes the left front and left rear portions CCC2, CCC3 of the auxiliary panel CCC to buckle. The eighth fold line 324 connecting the left front and left rear portions CCC2, CCC3 functions as a line of relative weakness compared to the rest of the left front and left rear portions CCC2, CCC3. As such, folding the left return portion BBB1 of the combination panel BBB about the third fold line 314 and folding the left wall portion BBB2 of the combination panel BB about the fourth fold line 316 automatically causes the left front portion CCC2 of the auxiliary panel CCC to fold with respect to the left rear portion CCC3 of the auxiliary panel about the eighth fold line 324, so that the left front portion CCC3 and the left rear portion CCC3 change state from co-planar with each other to three-dimensional with respect to each other, thereby defining a first space 352 defined by the left front and left rear portions CCC2, CCC3 of the auxiliary panel CCC and the left wall portion BBB2 of the combination panel BBB.

The extent to which the left front and left rear portions CCC2, CCC3 of the auxiliary panel CCC change state from co-planar with each other to three-dimensional with respect to each other is a function of the magnitude of the first and second predetermined distances SSS1, SSS2, as would be understood by one skilled in the art. The greater the magnitude of the first and second predetermined distances SSS1, SSS2, the further the left front and left rear portions CCC2, CCC3 of the auxiliary panel CCC change state from co-planar with each other to three-dimensional with respect to each other, and the larger the first space 352 becomes, when the preassembly 302 is manipulated as discussed above. Also, the greater the magnitude of the first and second predetermined distances SSS1, SSS2, the further the eighth fold line 324 is displaced away from the left wall panel BBB2 of the combination panel BBB when the preassembly 302 is manipulated as discussed above.

The relative locations of the fifth, sixth, tenth, eleventh, and twelfth fold lines 318, 320, 328, 330, 332 lead to a similar effect with respect to the right front and right rear portions CCC5, CCC6 of the auxiliary panel CCC and the right wall portion BBB4 of the combination panel when the right wall portion and the right return portion BBB4, BBB5 are folded as discussed above. Such folding yields a second space 354 similar to the first space 352.

The inner portion DDD1 of the front wall panel DD may be folded about the fourteenth fold line 336 to a position perpendicular to the bottom panel AAA. The outer portion DDD2 of the front wall panel DDD may be folded about the fifteenth fold line 338 (and about the optional auxiliary fold line 340, if provided), to a position parallel to the inner portion DDD2 of the front wall panel DDD, thereby encompassing the first tang TTT land the second tang TTT2. The first and second tabs 346, 348 extending from the front wall panel DDD may be engaged, respectively, with the first and second slots 342, 344 defined by the bottom panel AAA, thereby securing the front wall panel DDD to the bottom panel AAA.

With the container 304 so erected, the left front and left rear portions CCC2, CCC3 of the auxiliary panel CCC define a first V-shaped internal support structure VVV1 capable of supporting a portion of another container 304 thereupon. Similarly, right rear and right front portions CCC5, CCC6 of the auxiliary panel CCC define a second V-shaped internal support structure VVV2 capable of supporting a portion of another container 304 thereupon. The free edges of the left front, left rear, right rear, and right front portions CCC2, CCC3, CCC5, CCC6 of the auxiliary panel CCC may receive a vertical load from the another container 204 thereupon and transfer the load to the bottom panel AAA of the container 304.

In embodiments including them, the openings 350 may function as hand holds for the container 304.

The invention claimed is:

1. A single-piece blank for a retail-ready container, the blank comprising:

a bottom panel;

a combination panel connected to the bottom panel along a first fold line; and an auxiliary panel connected to the combination panel along a second fold line;

wherein the combination panel has a first portion, a second portion connected to the first portion along a third fold line perpendicular to the first fold line, and a third portion connected to the second portion along a fourth fold line parallel to the third fold line;

wherein the auxiliary panel has a first portion, a second portion connected to the first portion along a fifth fold line parallel to the third fold line, a third portion connected to the second portion along a sixth fold line parallel to the third fold line, and a fourth portion connected to the third portion along a seventh fold line parallel to the third fold line;

wherein the fifth fold line is spaced from the third fold line by a first predetermined distance;

wherein the fifth fold line is directed through the first portion of the combination panel;

wherein the seventh fold line is spaced from the fourth fold line by a second predetermined distance;

wherein the seventh fold line is directed through the third portion of the combination panel;

wherein the second portion of the combination panel is connected to the bottom panel along the first fold line;

wherein the first portion of the auxiliary panel is connected to the first portion of the combination panel along the second fold line; and wherein the fourth portion of the auxiliary panel is connected to the second portion of the combination panel along the second fold line.

2. A preassembly formed from the blank of claim 1 wherein the auxiliary panel is folded along the second fold line against the combination panel.

3. A retail-ready container formed from the preassembly of claim 2 wherein:

the first portion of the combination panel is folded along the third fold line to a position perpendicular to the second portion of the combination panel;

the first portion of the auxiliary panel is folded along the fifth fold line to a position perpendicular to the second portion of the combination panel;

the third portion of the combination panel is folded along the fourth fold line to a position perpendicular to the second portion of the combination panel;

the fourth portion of the auxiliary panel is folded along the seventh fold line to a position perpendicular to the second portion of the combination panel;

the second portion of the auxiliary panel is folded along the sixth fold line with respect to the third portion of the auxiliary panel; and the second portion of the combination panel is folded along the first fold line to a position perpendicular to the bottom panel.

4. The retail-ready container of claim 3 where the second portion of the auxiliary panel and the third portion of the auxiliary panel cooperate to define a V-shaped structure.

5. The retail-ready container of claim 4, wherein the V-shaped structure is configured to receive another container thereupon and to transfer the load of the another container to the bottom panel.

6. The blank of claim 1 further comprising:

a front wall panel having a first portion connected to the bottom panel along an eighth fold line parallel to the third fold line and a second portion connected to the first portion along a ninth fold line parallel to the third fold line;

a second combination panel connected to the bottom panel along a tenth fold line parallel to the first fold line; and a second auxiliary panel connected to the combination panel along an eleventh fold line parallel to the first fold line;

wherein the second combination panel has a first portion, a second portion connected to the first portion along a twelfth fold line perpendicular to the first fold line, and a third portion connected to the second portion along a thirteenth fold line parallel to the tenth fold line;

wherein the second auxiliary panel has a first portion, a second portion connected to the first portion along a fourteenth fold line parallel to the twelfth fold line, a third portion connected to the second portion along a fifteenth fold line parallel to the twelfth fold line, and a fourth portion connected to the third portion along a sixteenth fold line parallel to the twelfth fold line;

wherein the fourteenth fold line is spaced from the twelfth fold line by a third predetermined distance;

wherein the fourteenth fold line is directed through the first portion of the second combination panel;

wherein the sixteenth fold line is spaced from the thirteenth fold line by a fourth predetermined distance; and wherein the sixteenth fold line is directed through the third portion of the second combination panel.

7. A preassembly formed from the blank of claim 6 wherein the auxiliary panel is folded along the second fold line against the combination panel and wherein the second auxiliary panel is folded along the eleventh fold line against the second combination panel.

8. A retail-ready container formed from the preassembly of claim 5 wherein:

the first portion of the front wall panel is folded along the eighth fold line to a position perpendicular to the bottom panel;

the second portion of the front wall panel is folded along the ninth fold line to a position against the first portion of the front wall panel;

the first portion of the combination panel is folded along the third fold line to a position perpendicular to the second portion of the combination panel;

the first portion of the auxiliary panel is folded along the fifth fold line to a position perpendicular to the second portion of the combination panel;

the third portion of the combination panel is folded along the fourth fold line to a position perpendicular to the second portion of the combination panel;

the fourth portion of the auxiliary panel is folded along the seventh fold line to a position perpendicular to the second portion of the combination panel;

the second portion of the auxiliary panel is folded along the sixth fold line with respect to the third portion of the auxiliary panel;

the first portion of the second combination panel is folded along the twelfth fold line to a position perpendicular to the second portion of the second combination panel;

the first portion of the second auxiliary panel is folded along the fourteenth fold line to a position perpendicular to the second portion of the second combination panel;

the third portion of the second combination panel is folded along the thirteenth fold line to a position perpendicular to the second portion of the second combination panel;

the fourth portion of the second auxiliary panel is folded along the sixteenth fold line to a position perpendicular to the second portion of the second combination panel;

the second portion of the second auxiliary panel is folded along the fifteenth fold line with respect to the third portion of the second auxiliary panel; and the second position of the second combination panel is folded about the tenth fold line to a position perpendicular to the bottom panel.

9. The retail-ready container of claim 8 wherein the second portion of the auxiliary panel and the third portion of the auxiliary panel cooperate to define a V-shaped structure, and wherein the second portion of the second auxiliary panel and the third portion of the second auxiliary panel cooperate to define a second V-shaped structure.

10. The retail-ready container of claim 9 wherein the V-shaped structure and the second V-shaped structure are configured to receive another container thereupon and to transfer the load of the another container to the bottom panel.

11. The blank of claim 1 further comprising:

a front wall panel having a first portion connected to the bottom panel along an eighth fold line parallel to the third fold line and a second portion connected to the first portion along a ninth fold line parallel to the third fold line;

wherein the combination panel further comprises a fourth portion connected to the first portion along a tenth fold line parallel to the third fold line and a fifth portion connected to the first portion along an eleventh fold line parallel to the third fold line; and wherein the auxiliary panel further comprises a fifth portion connected to the first portion along a twelfth fold line parallel to the third fold line and a sixth portion connected to the fourth portion along an eleventh fold line parallel to the third fold line.

12. A preassembly formed from the blank of claim 11 wherein:

the auxiliary panel is folded along the second fold line against the combination panel; and wherein the second auxiliary panel is folded along the eleventh fold line against the second combination panel.

13. A retail-ready container formed from the preassembly of claim 12 wherein:

the first portion of the combination panel is folded along the third fold line to a position perpendicular to the second portion of the combination panel;

the first portion of the auxiliary panel is folded along the fifth fold line to a position perpendicular to the second portion of the combination panel;

the third portion of the combination panel is folded along the fourth fold line to a position perpendicular to the second portion of the combination panel;

the fourth portion of the auxiliary panel is folded along the seventh fold line to a position perpendicular to the second portion of the combination panel;

the second portion of the auxiliary panel is folded along the sixth fold line with respect to the third portion of the auxiliary panel;

the second portion of the combination panel is folded along the first fold line to a position perpendicular to the bottom panel;

the first portion of the front wall panel is folded along the eighth fold line to a position perpendicular to the bottom panel;

the second portion of the front wall panel is folded along the ninth fold line to a position against the first portion of the front wall panel;

the fourth portion of the combination panel is folded along the tenth fold line to a position perpendicular to the first portion of the combination panel;

the fifth portion of the auxiliary panel is folded along the twelfth fold line to a position perpendicular to the first portion of the auxiliary panel;

the fifth portion of the combination panel is folded along the eleventh fold line to a position perpendicular to the third portion of the combination panel; and the sixth portion of the auxiliary panel is folded along the thirteenth fold line to a position perpendicular to the fourth portion of the auxiliary panel.

14. The retail-ready container of claim 13 where the second portion of the auxiliary panel and the third portion of the auxiliary panel cooperate to define a V-shaped structure.

15. The retail-ready container of claim 14 wherein the V-shaped structure is configured to receive another container thereupon and to transfer the load of the another container to the bottom panel.

16. A single-piece blank for a retail-ready container, the blank comprising:

a bottom panel;

a combination panel connected to the bottom panel along a first fold line; and an auxiliary panel connected to the combination panel along a second fold line;

wherein the combination panel has a first portion, a second portion connected to the first portion along a third fold line perpendicular to the first fold line, a third portion connected to the second portion along a fourth fold line parallel to the third fold line, a fourth portion connected to the third portion along a fifth fold line parallel to the third fold line, and a fifth portion connected to the fourth portion along a sixth fold line parallel to the third fold line;

wherein the auxiliary panel has a first portion, a second portion connected to the first portion along a seventh fold line parallel to the third fold line, a third portion connected to the second portion along an eighth fold line parallel to the third fold line, a fourth portion connected to the third portion along a ninth fold line parallel to the third fold line a fifth portion connected to the fourth portion along a tenth fold line parallel to the third fold line, a sixth portion connected to the fifth portion along an eleventh fold line parallel to the third fold line, and a seventh portion connected to the sixth portion along a twelfth fold line parallel to the third fold line;

wherein the seventh fold line is spaced from the third fold line by a first predetermined distance;

wherein the seventh fold line is directed through the first portion of the combination panel;

wherein the ninth fold line is spaced from the fourth fold line by a first predetermined distance;

wherein the ninth fold line is directed through the third portion of the combination panel;

wherein the tenth fold line is spaced from the fifth fold line by a third predetermined distance;

wherein the tenth fold line is directed through the third portion of the combination panel;

wherein the tenth fold line is spaced from the sixth fold line by a fourth predetermined distance;

wherein the twelfth fold line is directed through the third portion of the combination panel;

wherein the third portion of the combination panel is connected to the bottom panel along the first fold line;

wherein the first portion of the auxiliary panel is connected to the first portion of the combination panel along the second fold line; and wherein the fourth portion of the auxiliary panel is connected to the third portion of the combination panel along the second fold line; and wherein the seventh portion of the auxiliary panel is connected to the sixth portion of the combination panel along the second fold line.

17. A preassembly formed from the blank of claim 16 wherein the auxiliary panel is folded about the second fold line against the combination panel.

18. A retail-ready container formed from the preassembly of claim 11 wherein:

the first portion of the combination panel is folded about the third fold line to a position perpendicular to the second portion of the combination panel, the second portion of the combination panel is folded about the fourth fold line to a position perpendicular to the third portion of the combination panel, the first portion of the auxiliary panel is folded about the seventh fold line to a position perpendicular to the second portion of the combination panel, the second portion of the auxiliary panel is folded about the eighth fold line with respect to the third portion of the auxiliary panel, and the second portion of the combination panel is folded about the first fold line to a position perpendicular to the bottom panel.

19. The retail-ready container of claim 18 wherein the second portion of the auxiliary panel and the third portion of the auxiliary panel cooperate to define a V-shaped structure.

20. The retail-ready container of claim 19 wherein the V-shaped structure is configured to receive another container thereupon and to transfer the load of the another container to the bottom panel.

21. The retail-ready container of claim 18 wherein:

the fifth portion of the combination panel is folded about the sixth fold line to a position perpendicular to the fourth portion of the combination panel, the fourth portion of the combination panel is folded about the fifth fold line to a position perpendicular to the third portion of the combination panel, the seventh portion of the auxiliary panel is folded about the twelfth fold line to a position perpendicular to the fourth portion of the combination panel, the fifth portion of the auxiliary panel is folded about the eleventh fold line with respect to the sixth portion of the auxiliary panel, and the fourth portion of the combination panel is folded about the first fold line to a position perpendicular to the bottom panel.

22. The retail-ready container of claim 21 wherein the fifth portion of the auxiliary panel and the sixth portion of the auxiliary panel cooperate to define a second V-shaped structure.

23. The retail-ready container of claim 22 wherein the second V-shaped structure is configured to receive another container thereupon and to transfer the load of the another container to the bottom panel.

* * * * *